US007909451B2

(12) United States Patent
Sugahara

(10) Patent No.: US 7,909,451 B2
(45) Date of Patent: Mar. 22, 2011

(54) PRINTING APPARATUS AND METHOD FOR FORMING PRINTED MATERIAL

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 858 days.

(21) Appl. No.: 11/879,095

(22) Filed: Jul. 16, 2007

(65) Prior Publication Data

US 2008/0012919 A1 Jan. 17, 2008

(30) Foreign Application Priority Data

Jul. 14, 2006 (JP) ..... 2006-193631

(51) Int. Cl.
*B05D 3/06* (2006.01)
*B41J 2/01* (2006.01)
*B41J 29/38* (2006.01)

(52) U.S. Cl. ..... 347/102; 347/9; 347/21

(58) Field of Classification Search ..... 347/9, 17, 347/21, 101, 102
See application file for complete search history.

(56) References Cited

U.S. PATENT DOCUMENTS 6,523,948 B2 * 2/2003 Matsumoto et al. ..... 347/102
7,131,723 B2 11/2006 Hoshino
7,152,970 B2 * 12/2006 Hasebe et al. ..... 347/102

FOREIGN PATENT DOCUMENTS

JP 8150707 6/1996
JP 2003089198 3/2003
JP 2004181943 7/2004
JP 2006110746 4/2006

* cited by examiner

*Primary Examiner* — Daniel Petkovsek
(74) *Attorney, Agent, or Firm* — Frommer Lawrence & Haug LLP

(57) ABSTRACT

In a printing section, inks of four colors and a transparent ink are jetted onto an image formation area of a recording paper on which an image is recorded, and a transparent ink is jetted onto an adhesion area at which the recording paper is adhered to the other recording paper. Thereafter, the ink on the image formation area is cured by irradiating ultraviolet rays to the image formation area, and with the transparent ink in the adhesion area not cured as the ultraviolet rays are not irradiated to the adhesion area, the recording paper is discharged to a paper discharge tray of an adhering section. When all the recording papers to be adhered are aligned in the paper discharge tray, the adhesion area of the plurality of recording papers is pressed and heated by a heating plate, and the recording papers P are adhered to each other.

16 Claims, 16 Drawing Sheets

PRINTING APPARATUS AND METHOD FOR FORMING PRINTED MATERIAL

CROSS-REFERENCE TO RELATED APPLICATION

The present application claims priority from Japanese Patent Application No. 2006-193631, filed on Jul. 14, 2006, the disclosure of which is incorporated herein by reference in its entirety.

BACKGROUND OF THE INVENTION

1. Field of the Invention

The present invention relates to a printing apparatus which performs recording of an image on a recording paper, and a method for forming a printed material (printed matter).

2. Description of the Related Art

Among printing apparatuses which record an image on a recording paper, a printing apparatus which records an image by jetting a photo-curable ink onto a recording paper is available. For example, in an ink-jet printing apparatus (printing apparatus) described in Japanese Patent Application Laid-open No. 2006-110746 (FIG. 1), an ultraviolet ink (photo-curable ink) is jetted from an ink jetting section onto a printing material (recording paper), then made to adhere to the printing material, and ultraviolet rays are irradiated from an UV irradiating section. The image is recorded by curing the ultraviolet ink to fix on the printing material.

Here, recording papers may be adhered to each other by a method such as binding by adhering one end portion of a plurality of recording papers on which images are recorded, upon superposing mutually (stacking) the recording papers, or superposing mutually two recording papers on which images are recorded, and then making an enclosure by adhering along an outer edge thereof. However, in an ink-jet printing apparatus disclosed in Japanese Patent Application Laid-open No. 2006-110746, a user is required to carry out jobs such as applying an adhesive on each recording paper on which an image is recorded, and adhering upon superposing the recording papers to which the adhesive is applied.

SUMMARY OF THE INVENTION

An object of the present invention is to provide a printing apparatus which is capable of recording an image on a recording paper by jetting a photo-curable ink, and simplifying a job to be carried out at the time of adhering (sticking) the recording papers on which images are recorded. A reference numeral in a bracket assigned to each component described below is merely an exemplification of that component, and does not restrict each component.

According to a first aspect of the present invention, there is provided a printing apparatus (1) which performs recording on a recording paper, including: a liquid jetting device (11 and 12) which has a first nozzle group (46) which jets a photo-curable ink onto a recording paper (P), and a second nozzle group (46) which jets a photo-curable liquid onto the recording paper; a light irradiating device (11 and 13) which irradiates light to the recording paper; a transporting mechanism (14, 15, 16, 17, and 18) which transports the recording paper along a transportation path (L) including a jetting position at which the ink and the liquid are jetted by the liquid jetting device, an irradiation position at which the light is irradiated by the light irradiating device, and a discharge position at which the recording paper is discharged; and a controller (4) which controls operation of the liquid jetting device, an operation of the light irradiating device, and an operation of the transporting mechanism; and in the transportation path, the discharge position is located downstream of the jetting position and the irradiation position; and the controls unit (4) controls the liquid jetting device, the light irradiating device, and the transporting mechanism such that the ink is jetted onto an image formation area (P1) of the recording paper (P), on which the image is to be recorded and the liquid is jetted onto an adhesion area (P2) of the recording paper, at which the recording paper is adhered to another recording paper, and that a light having a light-intensity not less than a minimum light-intensity required for curing the ink is irradiated to the image formation area onto which the ink is jetted, and a light having a light-intensity less than a minimum light-intensity required for curing the liquid is irradiated to the adhesion area onto which the liquid has been jetted or that the light is not irradiated onto the adhesion area.

According to the printing apparatus of the present invention, the ink jetted onto the image formation area is cured, and the liquid jetted onto the adhesion area is not cured. Therefore, by curing the liquid after aligning and stacking the plurality of recording papers transported to the discharge position, it is possible to adhere these recording papers mutually, at the adhesion area. Consequently, a job of applying an adhesive by a user to the plurality of recording papers on which the images have been recorded becomes unnecessary, and a job at the time of adhering the recording papers to each other is simplified.

In the printing apparatus (1) of the present invention, the adhesion area (P2) may differ from the image formation area (P1).

The printing apparatus (1) of the present invention may further include a paper holding mechanism (73 and 75) which holds a plurality of recording papers (P) transported by the transporting mechanism (14, 15, 16, 17, and 18) to the discharge position in a state that the recording papers are stacked and aligned mutually, and a liquid curing device (72) which cures the liquid discharged onto the adhesion area (P2) of the recording papers which are held by the paper holding mechanism. In this case, since the recording papers transported to the discharge position by the transporting mechanism are held in the state that the recording papers are stacked and aligned mutually, by the paper holding mechanism, and the liquid jetted onto the adhesion area is cured in this state by the liquid curing device, it is possible to adhere mutually the recording papers transported to the discharge position. Consequently, the job of applying the adhesive by the user to the plurality of recording papers on which the images have been recorded becomes unnecessary, and the job at the time of adhereing the recording papers to each other is simplified.

In the printing apparatus (1) of the present invention, the liquid curing device (72) may irradiate a light having a light-intensity not less than the minimum light-intensity required for curing the liquid to the adhesion area (P2). In this case, since the liquid is photo-curable, it is possible to cure the liquid by irradiating the light to the adhesion area.

In the printing apparatus (1) of the present invention, the liquid may have a thermosetting property (heat curability); and the liquid curing device may heat the adhesion area (P2) at a temperature not less than a minimum temperature required for curing the liquid. In this case, when the photo-curable liquid is a liquid having a thermosetting property such as an ultraviolet ink, it is possible to cure the liquid by heating the adhesion area.

In the printing apparatus (1) of the present invention, the liquid may be the ink, and at least a part of nozzles belonging to the first nozzle group (46) may serve as the second nozzle group (46). In this case, by jetting the ink onto the adhesion area from the first nozzle group, as a liquid for adhering the recording papers to each other, the second nozzle group is not required to be provided separately from the first nozzle group, to the liquid jetting device, and a structure of the liquid jetting device is simplified.

In the printing apparatus (1) of the present invention, the minimum light-intensity required for curing the liquid may be more than the minimum light-intensity required for curing the ink; and the controller (4) may control the light irradiating device (11 and 13) such that a light having the light-intensity not less than the minimum light-intensity required for curing the ink and having the light-intensity less than the minimum light-intensity required for curing the liquid is irradiated to the image formation area (P1) and the adhesion area (P2). In this case, since it is possible to cure only the ink by irradiating the light having the same intensity to the image formation area and the adhesion area, a control of the light irradiating device becomes easy.

According to a second aspect of the present invention, there is provided a printing apparatus (1) which performs recording on a recording paper, including: a liquid jetting device (11 and 12) which includes a first nozzle group (46) which jets a photo-curable ink onto a recording paper (P), and a second nozzle group (46) which jets, onto the recording paper, a photo-curable liquid requiring a curing time longer than a curing time for the ink; a light irradiating device (11 and 13) which irradiates light to the recording paper; a transporting mechanism (14, 15, 16, 17, and 18) which transports the recording paper along a transportation path (L) including a jetting position at which the ink and the liquid are jetted by the liquid jetting device, an irradiation position at which the light from the light irradiating device is irradiated, and a discharge position to which the recording paper is discharged; a paper holding mechanism (173) which holds a plurality of recording papers transported by the transporting mechanism to the discharge position in a state that the recording papers are stacked and aligned mutually; and a controller (4) which controls an operation of the liquid jetting device, the light irradiating device, and the transporting mechanism, and in the transportation path, the discharge position is located downstream of the jetting position and the irradiation position; and the controller controls the liquid jetting device, the light irradiating device, and the transporting mechanism such that the ink is jetted onto an image formation area (P1), of each of the recording papers, on which the image is to be recorded and the liquid is jetted onto an adhesion area (P2), of each of the recording papers, to adhere the other recording papers to each other, and that a light having a light-intensity not less than a minimum light-intensity required for curing both the ink and the liquid is irradiated to the image formation area onto which the ink has been jetted, and the adhesion area onto which the liquid has been jetted.

According to the printing apparatus (1) of the present invention, by irradiating light to the recording paper onto which the ink and the liquid have been jetted, the ink jetted onto the image formation area is cured, and later, the liquid jetted onto the adhesion area is cured. Consequently, by transporting the recording papers with only the ink cured thereon, to the discharge position, and arranging the recording paper in stacked (superposed) form by the paper holding mechanism, it is possible to adhere the plurality of recording papers mutually. Accordingly, the job of applying the adhesive by the user to a plurality of recording papers on which the images have been recorded becomes unnecessary, and adhereing the recording papers to which the adhesive is applied, mutually, upon stacking become unnecessary, and the job of adhering a plurality of recording papers to each other is simplified.

In the printing apparatus (1) of the present invention, the adhesion area (P2) may differ from the image formation area (P1), and the liquid may be transparent. In this case, since the liquid is transparent, it is possible to adhere a plurality of recording papers to each other without applying an unnecessary color to the adhesion area which differs from the image formation area.

In the printing apparatus (1) of the present invention, each of the recording papers (P) may be rectangular-shaped, and the adhesion area (P2) may be an area extending at one side portion of each of the recording papers along an outer edge of each of the recording papers. In this case, by letting an area extended along the outer edge of each of the recording papers, at one side portion of each of the rectangular shaped recording papers, to be the adhesion area, it is possible to perform binding by adhering a plurality of recording papers mutually.

In the printing apparatus (1) of the present invention, each of the recording papers (P) may be rectangular-shaped, and the adhesion area (P2) may be an area extending over an entire periphery along an outer edge of each of the recording papers. In this case, by letting the adhesion area to be the area extending over the entire periphery along the outer edge of the recording paper, it is possible to make an envelope by adhering two recording papers to each other.

The printing apparatus (1) of the present invention may further include an area changing section (205) which changes a position of the image formation area (P1) and a position of the adhesion area (P2) according to an instruction from an outside of the printing apparatus. In this case, since it is possible to change the image formation area and the adhesion area according to the instruction from the outside of the printing apparatus, it is possible to record an image at a desired position on the recording paper, and to adhere a plurality of recording papers mutually at a desired position.

In the printing apparatus (1) of the present invention, the transporting mechanism (14, 15, 16, 17, and 18) may be constructed such that each of the recording papers (P) is transported with a surface, onto which the liquid has been jetted, facing upward; and the paper holding mechanism (173) may be constructed such that the recording papers are held in a stacked state in which a recording paper, which is transported later among the printing papers, is on a top of the stack; and the controller (4) may control the liquid jetting device such that the liquid is not jetted onto the adhesion area (P2) of a recording paper which is transported last to the discharge position among the recording papers to be adhered mutually. In this case, since the recording paper is transported to the discharge position such that the surface onto which the liquid is jetted is facing upward, when the user takes out by mistake, a recording paper from the discharge position before all the recording papers are transported to the discharge position, it is possible to prevent the liquid jetted onto the recording paper to be discharged subsequently from being adhered to the printing apparatus. Moreover, since the recording paper discharged last is on the top, and there is no recording paper to be stuck thereon, by not jetting the liquid onto this recording paper, it is possible to prevent the excessive liquid from being adhered to this recording paper.

Moreover, in the printing apparatus of the present invention, the controller (4) may control the liquid jetting device (11 and 12) such that, upon recording a plurality of images on the recording papers (P) respectively in a predetermined order, the images are recorded on the recording papers respectively in an order which is reverse to the predetermined order. Accordingly, since the plurality of recording papers are arranged in a predetermined order from the top at the discharge position, by curing the liquid in this state, it is possible to adhere the plurality of recording papers mutually in a state that the recording papers are arranged in the predetermined order.

The printing apparatus (1) of the present invention, may further include a paper turning device (19) which turns over the recording papers (P) which have passed the discharge position and the irradiation position, and guides the recording papers to an upstream of the transportation path (L) to be located farther than the discharge position and the irradiation position, and the controller (4) may control operations of the liquid jetting device (11 and 12), the light irradiation unit (11 and 13), the transporting mechanism, and the paper turning device (19) such that before the recording papers are turned over, the liquid is not jetted onto the adhesion area (P2) on one surface of each of the recording papers and the ink is jetted onto the image formation area (P1) on the one surface of each of the recording papers, and the light is irradiated to the one surface onto which the ink is jetted, and that after the recording paper is turned over, the ink is jetted onto the image formation area on the other surface, of each of the recording papers, on a side opposite to the one surface onto which the ink has been jetted, and the liquid is jetted onto the adhesion area on the other surface, and light is irradiated to the other surface onto which the ink and the liquid have been jetted. Accordingly, in a case of recording images on a plurality of recording papers, and adhering these recording papers to each other, by not jetting the liquid onto the adhesion area on the one surface of each of the recording papers, and jetting the ink onto the image formation area, and curing the ink which is jetted before turning over the recording paper, and jetting the ink onto the image formation area on the other surface opposite to the surface onto which the ink is jetted, and jetting the liquid onto the adhesion area, after the recording paper is turned over, since the liquid is not jetted onto the recording paper before the recording paper is turned over, it is possible to prevent the liquid from adhering to the paper turning device (19).

Moreover, in the printing apparatus (1) of the present invention, in the transportation path (L), the irradiation position may be located downstream of the jetting position; and the light irradiating device (213) may include a plurality of light sources which are provided facing the irradiation position, and arranged to be aligned along an entire length of each of the recording papers, in a direction orthogonal to a direction in which each of the recording papers (P) is transported at the irradiation position. In general, in many cases the image formation area is provided at a central portion of the recording paper, and the adhesion area is provided in an area around an outer edge of the recording paper. Accordingly, in such a case, a frequency of changing the intensity of light irradiated by the light source is reduced, and it is possible to make longer a life of the light source.

In the printing apparatus (1) of the present invention, the light irradiating device (11 and 13) may include a light source which irradiates the light to the recording paper (P); and a reciprocating mechanism (11) which reciprocates the light source (13), at a position facing the irradiation position, over an entire length of each of the recording papers, in a direction orthogonal to a direction in which the recording paper is transported at the irradiation position. Accordingly, by irradiating light from the light source while reciprocating by the reciprocating mechanism in the direction orthogonal to the direction in which the recording paper is transported, it is possible to irradiate light on the entire recording paper, and to reduce the number of light sources.

According to a third aspect of the present invention, there is provided a printing apparatus (1) including: an ink-jet head (12) which includes a first nozzle group (46) which jets a photo-curable ink onto a recording paper (P), and a second nozzle group (46) which jets an adhesive liquid which adheres the recording papers to an object; a light source (13) which irradiates a light to the recording paper; and a transporting mechanism (14, 15, 16, 17, and 18) which transports the recording paper.

According to the printing apparatus of the present invention, by irradiating a light from a light irradiating device on the ink which is jetted onto the recording paper from the first nozzle group, it is possible to fix to the recording paper an image formed by the ink. On the other hand, it is possible to jet from the second nozzle group, an adhesive liquid which sticks the recording papers, onto the recording paper. The printing apparatus of the present invention, while having a simple structure, particularly by using a single head, is capable of getting rid of a job of applying adhesive by the user to the plurality of recording papers on which the images have been recorded, and simplifying a job at the time of adhering the plurality of recording papers to each other.

The printing apparatus (1) of the present invention may further include an ink supply section (C1, C2, C3, C4, T1, T2, T3, and T4) which supplies an ink to the first nozzle group (46), and an adhesive liquid supply section (C5 and T5) which supplies an adhesive liquid to the second nozzle group (46). Accordingly, it is possible to supply different liquids to the first nozzle group and the second nozzle group respectively.

According to a fourth aspect of the present invention, there is provided a method of forming printed material including: applying ink by jetting a photo-curable ink from an ink-jet head (3) onto a plurality of recording papers (P); curing the ink applied to an image formation area (P1) of each of the printing papers by irradiating a light to the image formation area, and adhering the recording papers by the ink applied to an adhesion area (P2) of each of the recording papers.

According to the method for forming the printed material of the present invention, since it is possible to use the photo-curable ink for printing as well as adhesion, the job of applying the adhesive by the user, to the plurality of recording papers on which the images have been recorded becomes unnecessary, and it is possible to simplify the job at the time of adhering the recording papers to each other. Moreover, since it is not necessary to prepare an adhesive, apart from the ink, it is possible to reduce a cost at the time of forming the printed matter.

In the method for forming the printed material of the present invention, the photo-curable ink may have a thermosetting property (heat curability), and the recording papers may be adhered to each other by heating the ink applied to the adhesion area. In this case, since the ink applied to the adhesion area of the recording paper is cured by heating, it is possible to adhere the recording papers to each other.

DETAILED DESCRIPTION OF THE PREFERRED EMBODIMENTS

A first embodiment of the present invention will be described below.

Figure 1A:
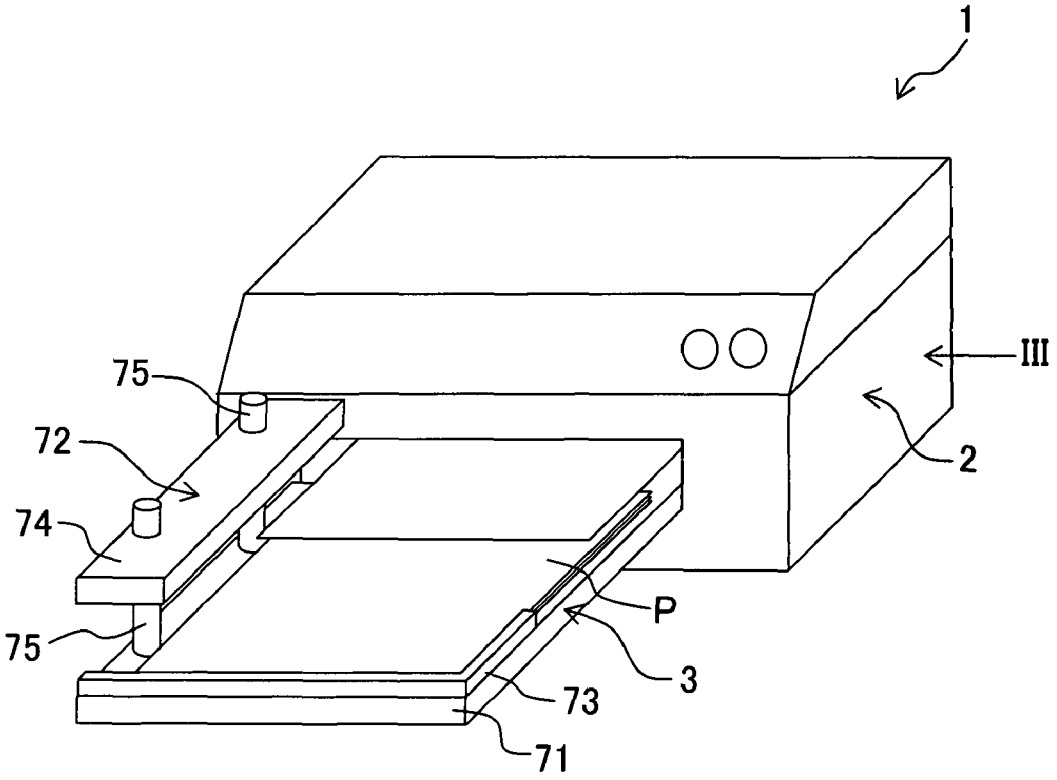
FIG. 1A is a schematic structural diagram of a printing apparatus according to a first embodiment of the present invention.

FIG. 1A is a schematic perspective view of a printing apparatus according to the first embodiment of the present invention. As shown in FIG. 1A, a printing apparatus 1 includes a printing section 2 which records an image on a recording paper P, and an adhering section 3 which adheres a plurality of the recording papers P to each other. Moreover, an operation of the printing section 2 and the adhering section 3 is controlled by a controller 4 (refer to FIG. 9) which will be described later.

Figure 2:
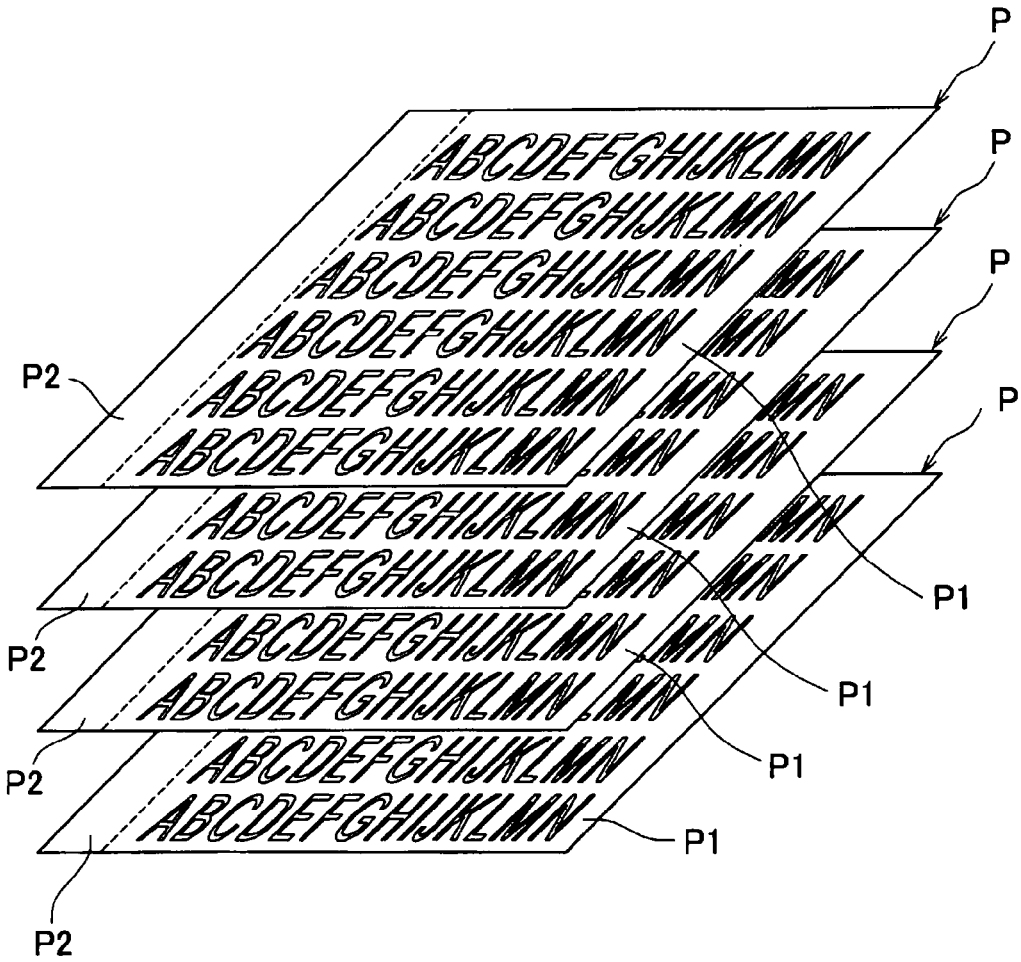
FIG. 2 is a diagram showing an area on a recording paper.

FIG. 2 is an exploded perspective view of the recording papers P which are adhered to each other in the adhering section 3, upon recording an image in the printing section 2 of the printing apparatus 1 in FIG. 1A. As shown in FIG. 2, the recording paper P has a rectangular flat shape. An area extending along an outer edge of the recording paper P of a long-side portion (one side portion) of one of the long sides (left side in FIG. 2) is an adhesion area P2 for adhering the recording papers P to each other, and an area excluding the adhesion area P2 on the recording paper P is an image formation area P1 on which an image is recorded. In the printing apparatus 1, as shown below, an image is recorded on the image formation area P1 of the recording papers P, and binding is carried out by adhering the recording papers P to each other in the adhesion area P2.

Figure 3:
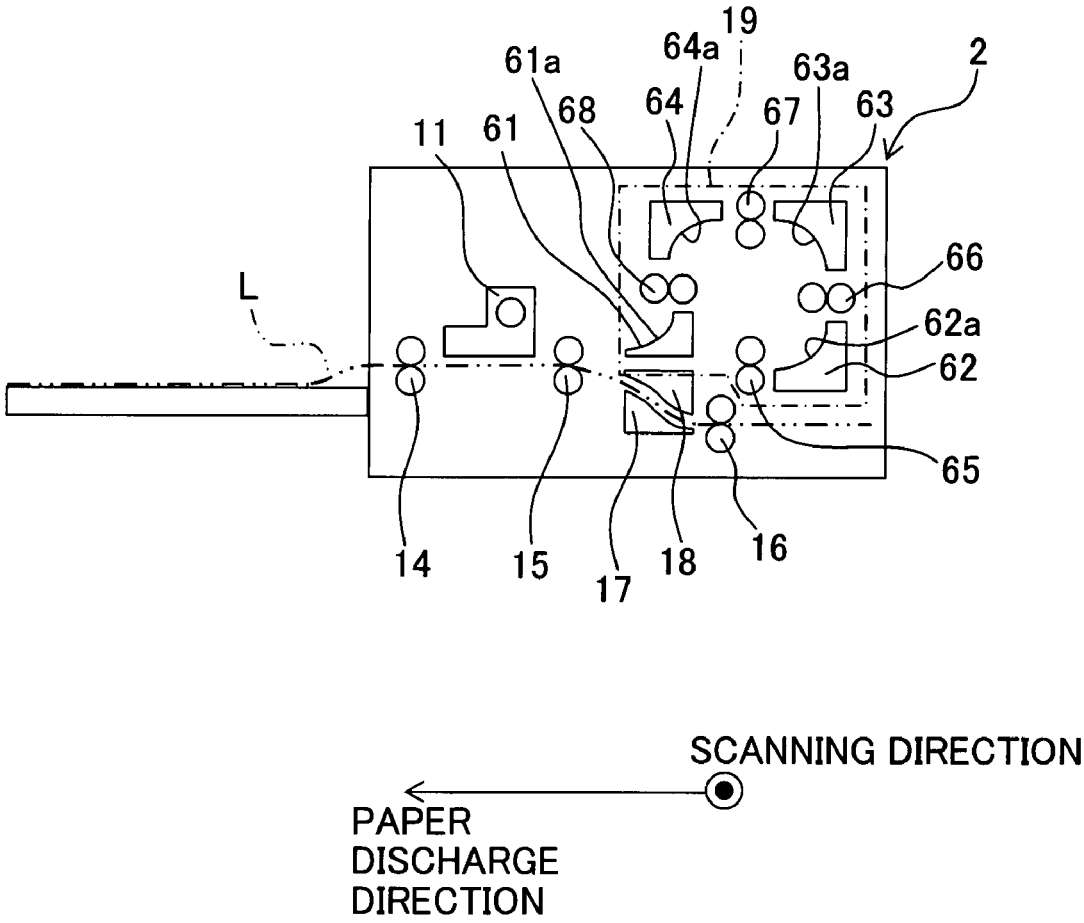
FIG. 3 is a side view of the printing apparatus when viewed from a direction of an arrow III in FIG. 1.
Figure 4:
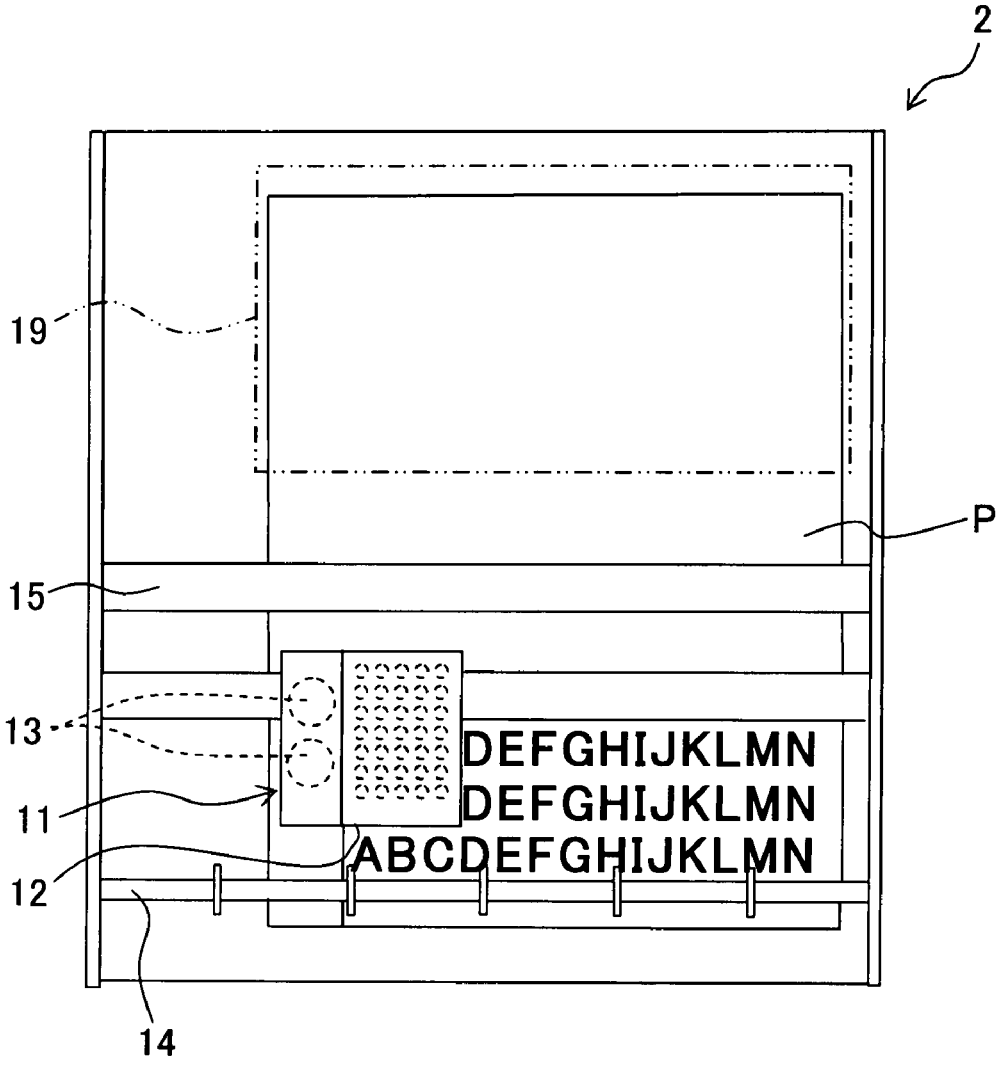
FIG. 4 is a plan view of an inside of the printing section in FIG. 1.

The printing section 2 will be described by using FIG. 3 and FIG. 4. FIG. 3 is a side view of the printing apparatus 1 including an inner portion of the printing section 2, when FIG. 1A is viewed from a direction of an arrow III. FIG. 4 is a plan view of the inner portion of the printing section 2 in FIG. 1A. As shown in FIG. 3 and FIG. 4, the printing section 2 includes a carriage (reciprocating mechanism) 11, light sources 13 and an ink-jet head 12 installed on a lower surface of the carriage 11, a transporting mechanism which includes three pairs of paper transporting rollers 14, 15, and 16 which transport the recording paper P, walls 17 and 18, and a paper turning device (turn bay) 19.

The carriage 11 reciprocates in a scanning direction (left and right direction in FIG. 4). The ink-jet head 12 jets onto the recording paper P a UV curable ink (ink which is photo-curable, and a liquid which is photo-curable), from a nozzle 46 provided on a lower surface thereof, while reciprocating in the scanning direction along with the carriage 11. The light sources 13 are arranged in two rows along a vertical direction in FIG. 4, and irradiate ultraviolet rays (light) on the recording paper P, while reciprocating in the scanning direction with the carriage 11. In this manner, since the light sources 13 irradiate the ultraviolet light rays on the recording paper P while moving in the scanning direction along with the carriage 11, a small number of the light sources 13 serves the purpose. The carriage 11 and the ink-jet head 12 combined together correspond to a liquid jetting device of the present invention. The carriage 11 and the light sources 13 combined together, correspond to a light irradiating device of the present invention.

The paper transporting rollers 14, 15, and 16 transport the recording paper P along a transportation path L shown by an alternate long and two short dashes line in FIG. 3. The walls 17 and 18 are arranged between the paper transporting rollers 15 and the paper transporting rollers 16. The walls 17 and 18 are arranged to be facing mutually, in a vertical direction in FIG. 3, and a gap which forms a part of the paper transportation path L through which the recording paper P passes, is formed. The recording paper P which is transported toward a left side in FIG. 3 by the paper transporting rollers 16, passes through this gap and reaches the paper transporting rollers 15. The paper transporting rollers 14 and 15 transport the recording paper P transported by the paper transporting rollers 16, further toward the left side in FIG. 3, and each portion of the recording paper P is transported to a position (jetting position, irradiation position) in the transportation path L, facing the light sources 13 and the ink-jet head 12, and discharges the recording paper P having the image recorded thereon, to a paper discharge tray 71 of the adhering section 3 (transport the recording paper P to a discharge position). Further, the paper transporting rollers 14 and 15, at the time of recording images on both surfaces of the recording paper P, transport the recording paper P having an image recorded on one surface, to the paper turning device 19 on a right side in FIG. 3. The paper turning device 19, after turning the recording paper P having an image recorded on one surface (having passed the jetting position and the irradiation position) at the time of recording images on both surfaces of the recording paper P, guides once again the recording paper P to the paper transportation path L.

Here, the paper transportation path L is at an upstream as moving toward a right side in FIG. 3, and in the paper transportation path L, the jetting position and the irradiation position of the present invention coincide (match), and a discharge position of the present invention is at a downstream of the jetting position and the irradiation position. Moreover, the paper turning device 19 guides the recording paper P which is turned, to upstream of the paper transportation path L located farther than the jetting position and the irradiation position.

Figure 1B:
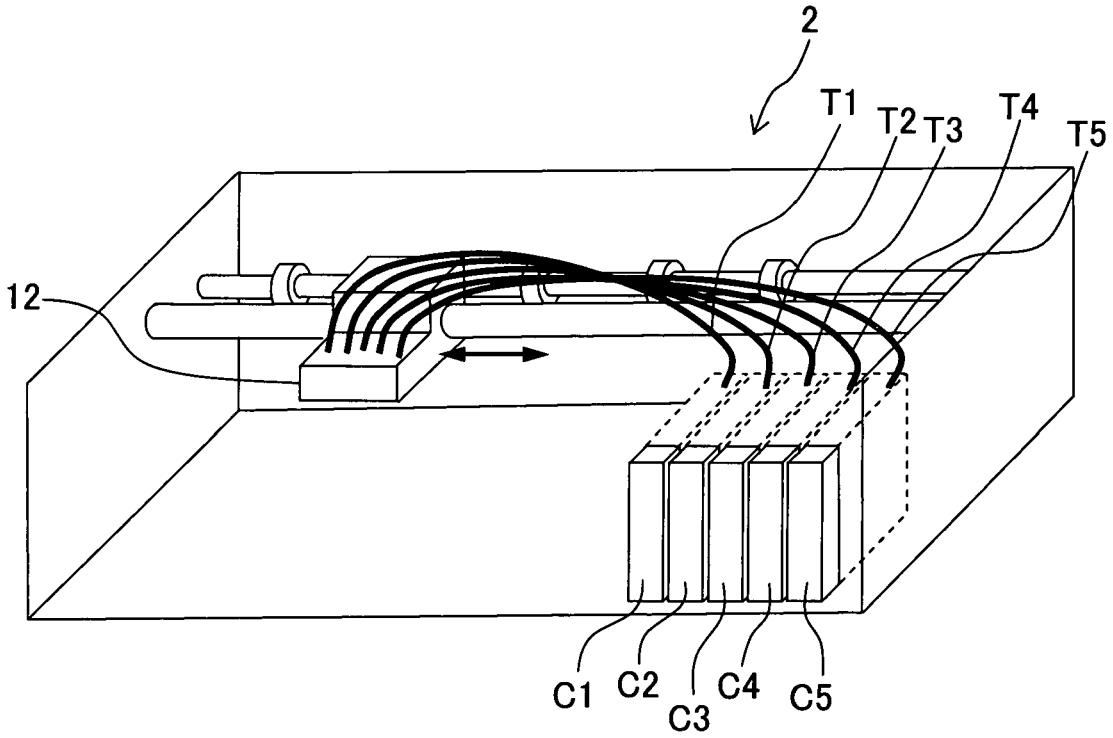
FIG. 1B is a diagram showing an ink cartridge which is connected to an ink-jet head by an ink supply tube, in a printing section.
Figure 5:
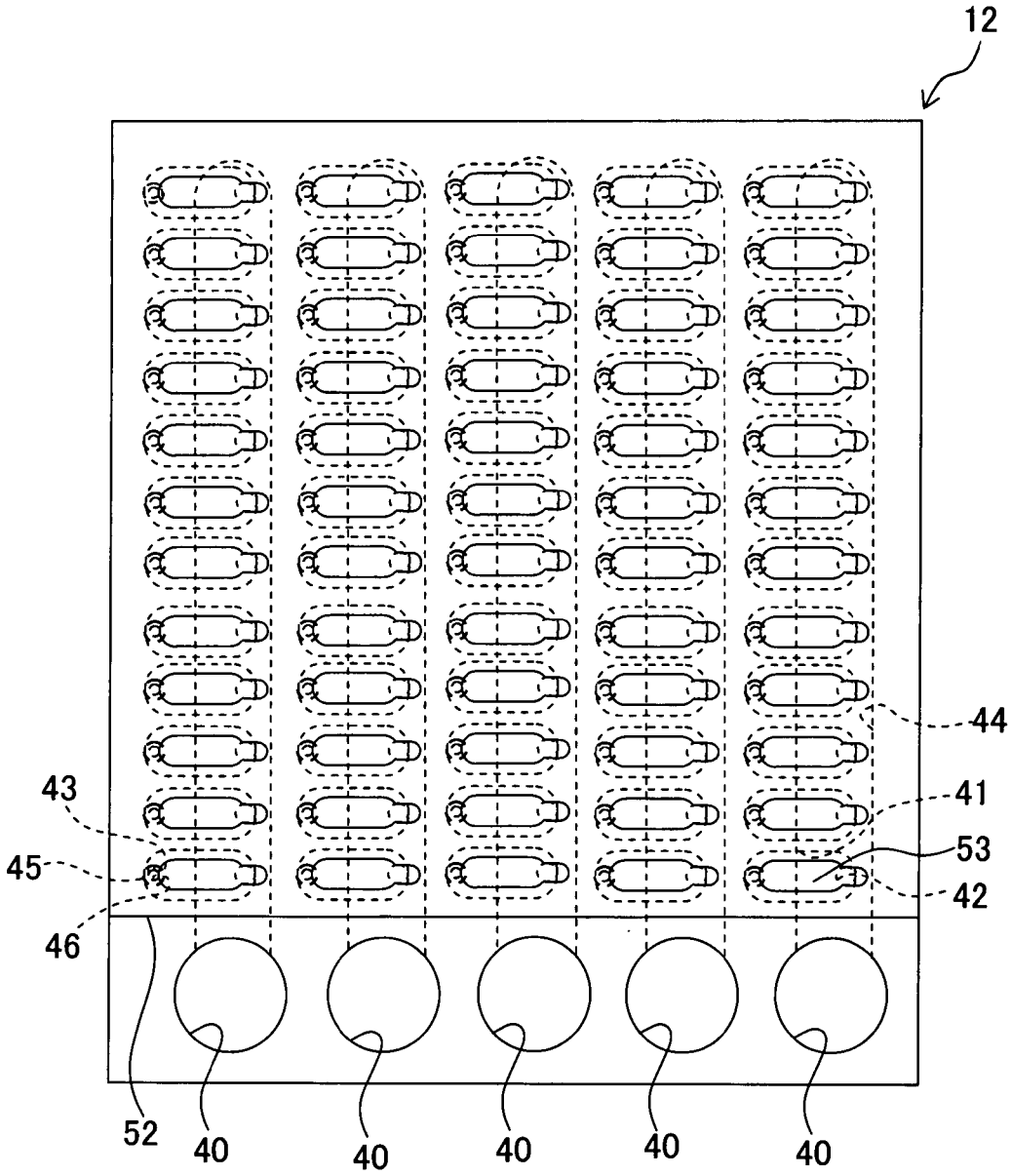
FIG. 5 is a plan view of an ink-jet head in FIG. 3.
Figure 6:
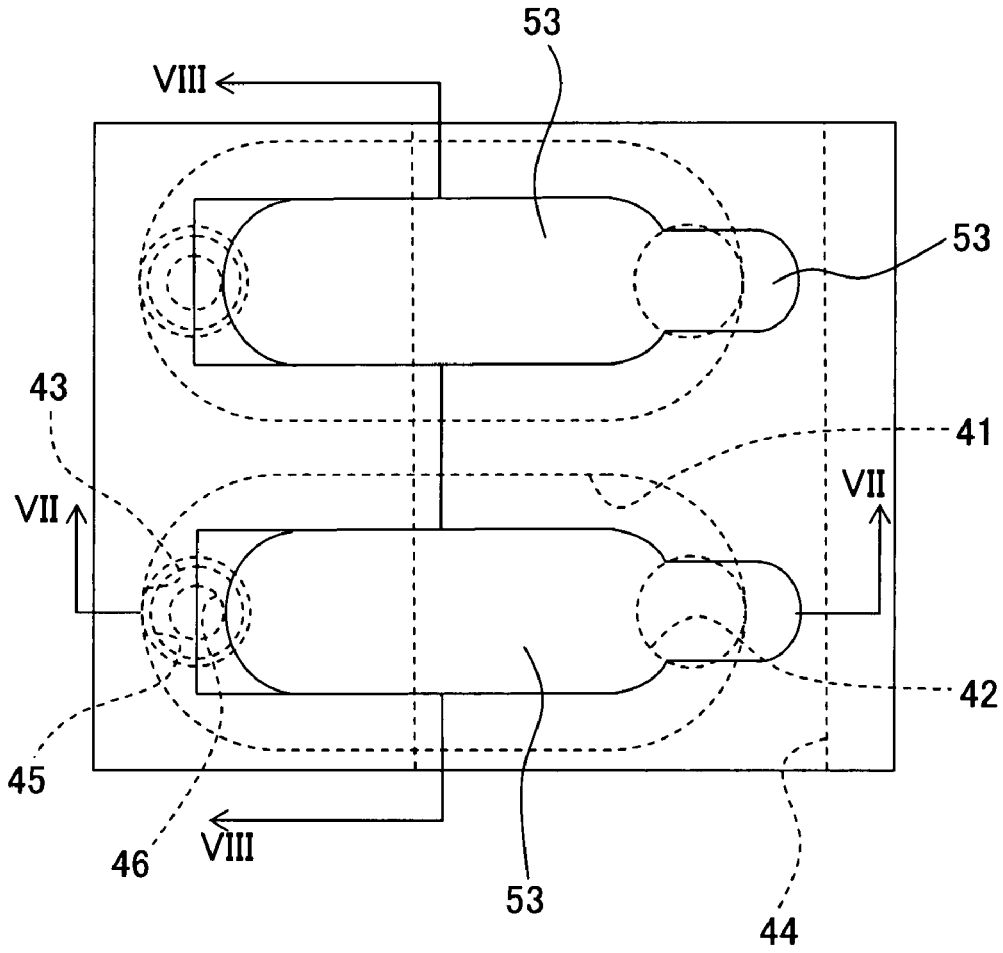
FIG. 6 is a partially enlarged view of FIG. 5.
Figure 7:
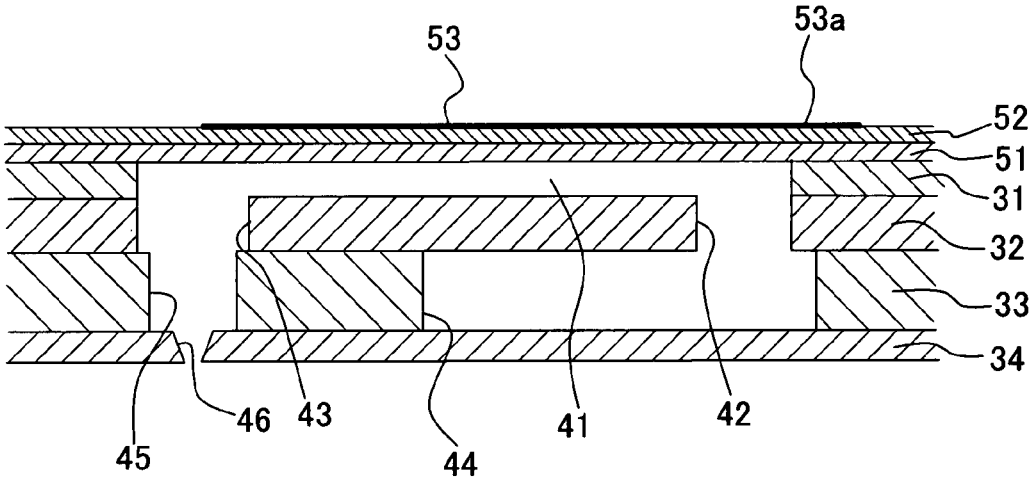
FIG. 7 is a cross-sectional view taken along a line VII-VII in FIG. 6.
Figure 8:
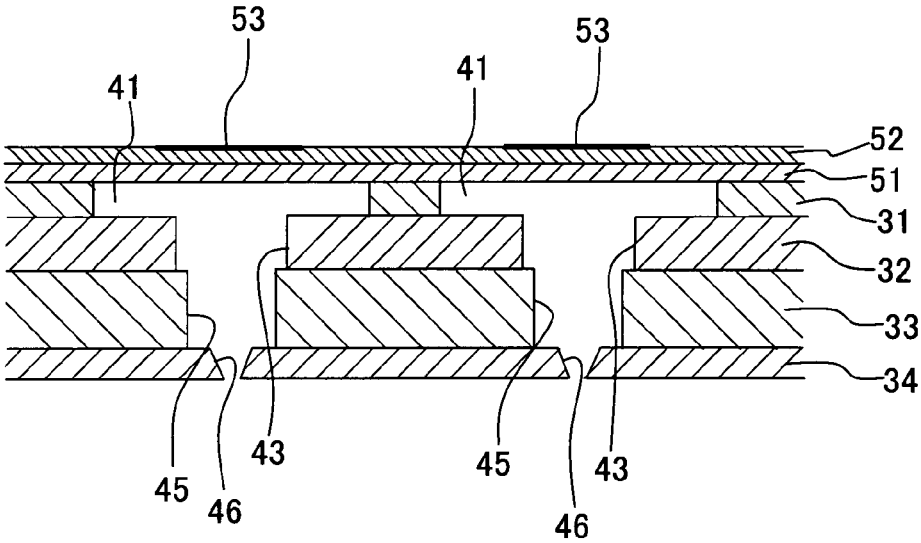
FIG. 8 is a cross-sectional view taken along a line VIII-VIII in FIG. 6.

Next, the ink-jet head 12 will be described by referring to FIG. 1B, and FIG. 5 to FIG. 8. FIG. 1B is a diagram showing ink cartridges C1 to C5 connected to the ink-jet head 12, by ink supply tubes T1 to T5 in the printing section 2. FIG. 5 is a plan view of the ink-jet head 12 in FIG. 4. FIG. 6 is a partially enlarged view of FIG. 5. FIG. 7 is a cross-sectional view taken along a line VII-VII in FIG. 6. FIG. 8 is a cross-sectional view taken along a line VIII-VIII in FIG. 6.

As shown in FIG. 5 to FIG. 8, the ink-jet head 12 includes a channel unit 21 in which, nozzles 46, pressure chambers 41, and ink channels such as a manifold channel 44 are formed, and a piezoelectric actuator 22 which is arranged on an upper surface of the channel unit 21, and which applies, to the ink in the pressure chambers 41, a pressure for jetting from the nozzles 46.

The channel unit 21 is formed by stacking four plates each other namely a cavity plate 31, a base plate 32, a manifold plate 33, and a nozzle plate 34. From among these four plates, the three plates 31 to 33, except for the nozzle plate 34, are made of a metallic material such as stainless steel. The nozzle plate 34 is made of a synthetic resin material such as polyimide. Or, the nozzle plate 34 may also be formed of a metallic material, similarly as the other three plates 31 to 33.

A plurality of pressure chambers 41 is formed in the cavity plate 31 as shown in FIG. 5 to FIG. 8. The pressure chambers 41 have a substantially elliptical shape, with a left and right direction in FIG. 5 in a plan view, as a longitudinal direction. Moreover, the pressure chambers 41 are arranged in five rows in the left and right direction in FIG. 5, and in each row of the pressure chambers 41, 12 pressure chambers 41 are arranged in a vertical direction in FIG. 5.

A plurality of through holes 42 and 43 having a substantially circular shape are formed in the base plate 32, at positions overlapping with both end portions in the longitudinal direction of the pressure chambers 41, in a plan view. Five manifold channels 44 extending in the vertical direction in FIG. 5 and arranged in the left and right direction in FIG. 5 are formed in the manifold plate 33, corresponding to the five rows of the pressure chambers 41. The manifold channel 44 communicates with the through hole 42 in the corresponding row of the pressure chambers 41. Ink is supplied to each manifold channel 44 from five ink supply ports 40 formed in a vibration plate 51 which will be described later, at a portion facing a lower end portion of each manifold channel 44 in FIG. 5, in a plan view. Moreover, a plurality of through holes 45 having a substantially circular shape is formed in the manifold plate 33, at positions overlapping with the through holes 43 in a plan view.

A plurality of nozzles 46 facing the through holes 45 in a plan view, is formed in the nozzle plate 34. The nozzles 46 are arranged in five rows in a left and right direction in FIG. 5, corresponding to the pressure chambers 41, and in each row, 12 nozzles 46 are arranged in a vertical direction in FIG. 5.

Here, from among the five rows of nozzles 46, UV curable inks of black, magenta, cyan, and yellow color are jetted respectively from the nozzles 46 (first nozzle group) belonging to the four rows of nozzles except for the row of nozzles on an extreme left side in FIG. 5, in order from the nozzles belonging to a row on the left side. The inks of these four colors are inks for recording an image on the recording paper P as it will be described later, and are jetted onto the image forming area P1 of the recording paper P. On the other hand, UV curable transparent ink (liquid) is jetted from the nozzles 46 (second nozzle group) belonging to the row at the extreme left side. This transparent ink, as it will be described later, is for adhering the plurality of recording papers P to each other, and is jetted onto the adhesion area P2 of the recording paper P. Furthermore, at the time of recording an image, it is also possible to use the transparent ink for making a light color of the inks of four colors described above, and in this case, the transparent ink is also jetted onto the image formation area P1. Moreover, the inks of four colors and the transparent ink have almost the same constituents except for a color material which forms each color, and almost the same minimum intensity of ultraviolet rays which is necessary for curing. In additions, the inks of four colors and the transparent ink also have a thermosetting property (heat curability) due to which the ink is cured when heated above a predetermined temperature.

In this manner, in the channel unit 21, the manifold channel 44 communicates with the pressure chamber 41 via the through hole 42, and the pressure chamber 41 communicates with the nozzle 46 via the through holes 43 and 45. In other words, a plurality of individual ink channels running from an exit of the manifold channel 45, up to the nozzle 46 via the pressure chamber 41, is formed in the channel unit 21. In the printing section 2, as shown in FIG. 1B, the ink cartridges C1, C2, C3, and C4 for inks of four colors, and an ink cartridge C5 for a transparent ink (adhesive liquid) are provided. Each of the ink cartridges C1 to C5 are connected to the ink supply port 40 of the ink-jet head 12, via the ink supply tubes T1 to T5 connected to the ink cartridges C1 to C5 respectively. The inks of four colors and the transparent ink are supplied from the ink cartridges C1 to C5 respectively, via the ink supply tubes T1 to T5, and the ink supply port 40 of the ink-jet head 12.

Next, the piezoelectric actuator 22 will be described below. The piezoelectric actuator 22 includes a vibration plate 51, a piezoelectric layer 52, and a plurality of individual electrodes 53.

The vibration plate 51 is a substantially rectangular-shaped plate when viewed in a plan view, made of a metallic material. The vibration plate 51 is arranged on the upper surface of the channel unit 21, to cover a plurality of pressure chambers 10, and is joined to an upper surface of the cavity plate 31. Moreover, the vibration plate 51 made of an electroconductive metallic material also serves as a common electrode sandwiching the piezoelectric layer 52 between the individual electrode 53 and the vibration plate 51, and is kept at a ground electric potential all the time.

The piezoelectric layer 52 is made of a piezoelectric material which is composed of mainly lead zirconate titanate (PZT) which is a solid solution of lead titanate and lead zirconate, and is a ferroelectric substance, and is formed on an upper surface of the vibration plate 51, to cover the pressure chambers 41. Moreover, the piezoelectric layer 52 is polarized in advance, in a direction of thickness.

The individual electrodes 53 have a substantially elliptical shape slightly smaller than the pressure chamber 41, and are arranged to overlap a substantially central portion of the respective pressure chambers 41. One end in a longitudinal direction (right side in FIG. 5), of each individual electrodes 53 is extended up to a position not facing the pressure chamber 41, and a front-end portion thereof is a contact point 53*a*. A flexible printed circuit (FPC) which is not shown in the diagram is connected to the contact point 53*a*, and a driving electric potential is applied to the individual electrode 53 from a drive IC which is not shown in the diagram, via the FPC.

Here, a driving method of the piezoelectric actuator 22 will be described. In the piezoelectric actuator 22, when a driving electric potential is applied to the individual electrode 53 corresponding to the nozzle 46 which jets the ink, an electric potential difference is generated between the individual electrode 53 to which the driving electric potential is applied, and the vibration plate 51 also serving as a common electrode kept at the ground electric potential, and an electric field is generated in a direction of thickness of the piezoelectric layer 52, in a portion sandwiched between the individual electrode 53 and the vibration plate 51. Since a direction of this electric field coincides (matches) with a direction in which the piezoelectric layer 52 is polarized, this portion of the piezoelectric layer 52 is contracted in a horizontal direction which is orthogonal to the direction of thickness, and along with the contraction of this portion of the piezoelectric layer 52, the vibration plate 51 and the piezoelectric layer 52 are deformed such that a projection is formed toward the pressure chamber 41. Accordingly, there is a decrease in a volume of the pressure chamber 41. As the volume of the pressure chamber 41 is decreased, a pressure on the ink in the pressure chamber 41 is increased, and the ink is jetted from the nozzle 46 communicating with the pressure chamber 41.

Coming back to FIG. 3, a paper turning device 19 will be described below. As shown in FIG. 3, the paper turning device 19 includes the wall 18 extending in the scanning direction of the carriage 11 (vertical direction with respect to a paper surface), walls 61, 62, 63, and 64 (walls 61 to 64), and four pairs of paper turning rollers 65, 66, 67, and 68 (for pairs of paper turning rollers 65 to 68), which form a part of the transportation path L.

The wall 61 is positioned on an upper side of the wall 18, and a gap which is extended in a horizontal direction is formed between an upper surface of the wall 18 and a lower surface of the wall 61. Moreover, an upper surface 61*a* of the wall 61 is curved such that a thickness of the wall 61 is decreased gradually toward a paper discharge direction. The wall 62 is positioned in a direction opposite to the paper discharge direction, with respect to the wall 61, and an upper surface 62*a* of the wall 62 is curved such that a thickness of the wall 62 is decreased gradually toward the paper discharge direction. The wall 63 is positioned at an upper side of the wall 62, and a lower surface 63 of the wall 63 is curved such that a thickness of the wall 63 is decreased gradually toward the paper discharge direction. The wall 64 is positioned in the paper discharge direction with respect to the wall 63, and is arranged at an upper side of the wall 61, and a lower surface 64*a* of the wall 64 is curved such that a thickness of the wall 64 is decreased gradually toward a direction opposite to the paper discharge direction.

The paper turning rollers 65 are provided between the wall 61 and the wall 62, and transport in the direction opposite to the paper discharge direction, the recording paper P which is transported by passing between the wall 61 and the wall 18. Accordingly, the recording paper P is transported up to the upper surface 62*a* of the wall 62, and further, is transported along the upper surface 62*a* of the wall 62, and reaches the paper turning rollers 66.

The paper turning rollers 66 are provided between the wall 62 and the wall 63, and transport in an upward direction the recording paper P which is transported along the upper surface 62*a* of the wall 62. Accordingly, the recording paper P is transported up to the lower surface 63*a* of the wall 63, and further, is transported along the lower surface 63*a* of the wall 63, and reaches the paper turning rollers 67.

The paper turning rollers 67 are provided between the wall 63 and the wall 64, and transport in paper discharge direction, the recording paper P which is transported along the lower surface 63*a* of the wall 63. Accordingly, the recording paper P is transported up to the lower surface 64*a* of the wall 64, and further, is transported along the lower surface 64*a* of the wall 64, and reaches the paper turning rollers 68.

The paper turning rollers 68 are provided between the wall 64 and the wall 61, and transport in a downward direction the recording paper P which is transported along the lower surface 64*a* of the wall 64. Accordingly, the recording paper P is transported up to the upper surface 61*a* of the wall 61, and further, is transported along the upper surface 61*a* of the wall 61, and is guided to the upstream of the paper transportation path L, which is located farther to a position facing the ink-jet head 12 and the light sources 13.

In this manner, the recording paper P which is transported between the wall 18 and the wall 61 is transported along the upper surfaces 61*a* and 62*a* of the walls 61 and 62, and the lower surfaces 63*a* and 64*a* of the walls 63 and 64, by the paper turning rollers 65 to 68, and is guided to the paper transportation path L in a turned state.

Coming back to FIG. 1, the adhering section 3 will be described below. As shown in FIG. 1, the adhering section 3 includes the paper discharge tray 71, and a heating device (liquid curing device) 72.

The recording paper P on which, an image has been recorded in the printing section 2 is discharged to the paper discharge tray 71. Here, when the plurality of recording papers P are discharged to the paper discharge tray 71, the recording paper P discharged secondarily or later is discharged on a recording paper P discharged previously. In other words, in a case of the plurality of recording papers P, the recording paper P discharged later is stacked on top of the recording papers P discharged previously.

Moreover, a wall 73 projected in a vertical direction is provided along an edge of an upper surface of the paper discharge tray 71, at an end portion of the paper discharge tray 71, on a side opposite to the printing section 2, and at a right end portion of the paper discharge tray 71 in FIG. 1. The recording paper P which is discharged is aligned by being brought into contact with the wall 73 and a side surface of a guide shaft 75 which will be described later, and is arranged at the same position in a plan view, of the paper discharge tray 71. Accordingly, the recording papers P are kept in a state that the recording papers are stacked and aligned. The wall 73 and the guide shaft 75 correspond to a paper holding mechanism of the present invention.

A heating device 72 is provided at an end portion on a left side of the paper discharge tray 71 in FIG. 1. The heating device 72 includes a heating plate 74 having a substantially rectangular shape in a plan view, which presses the recording papers P while heating, and two guide shafts 75 having a substantially circular cylindrical shape and extending in a vertical direction. The heating plate 74 is arranged to face the adhesion area P2 of the recording paper P which is discharged to the paper discharge tray 71, and is movable in a vertical direction along the guide shaft 75. Moreover, by a downward movement of the heating plate 74, along the vertical direction, the heating plate 74, while pressing the adhesion area P2 of the recording paper P discharged to the paper discharge tray 71, is heated at a temperature same as or more than the minimum temperature required for curing the transparent ink.

Figure 9:
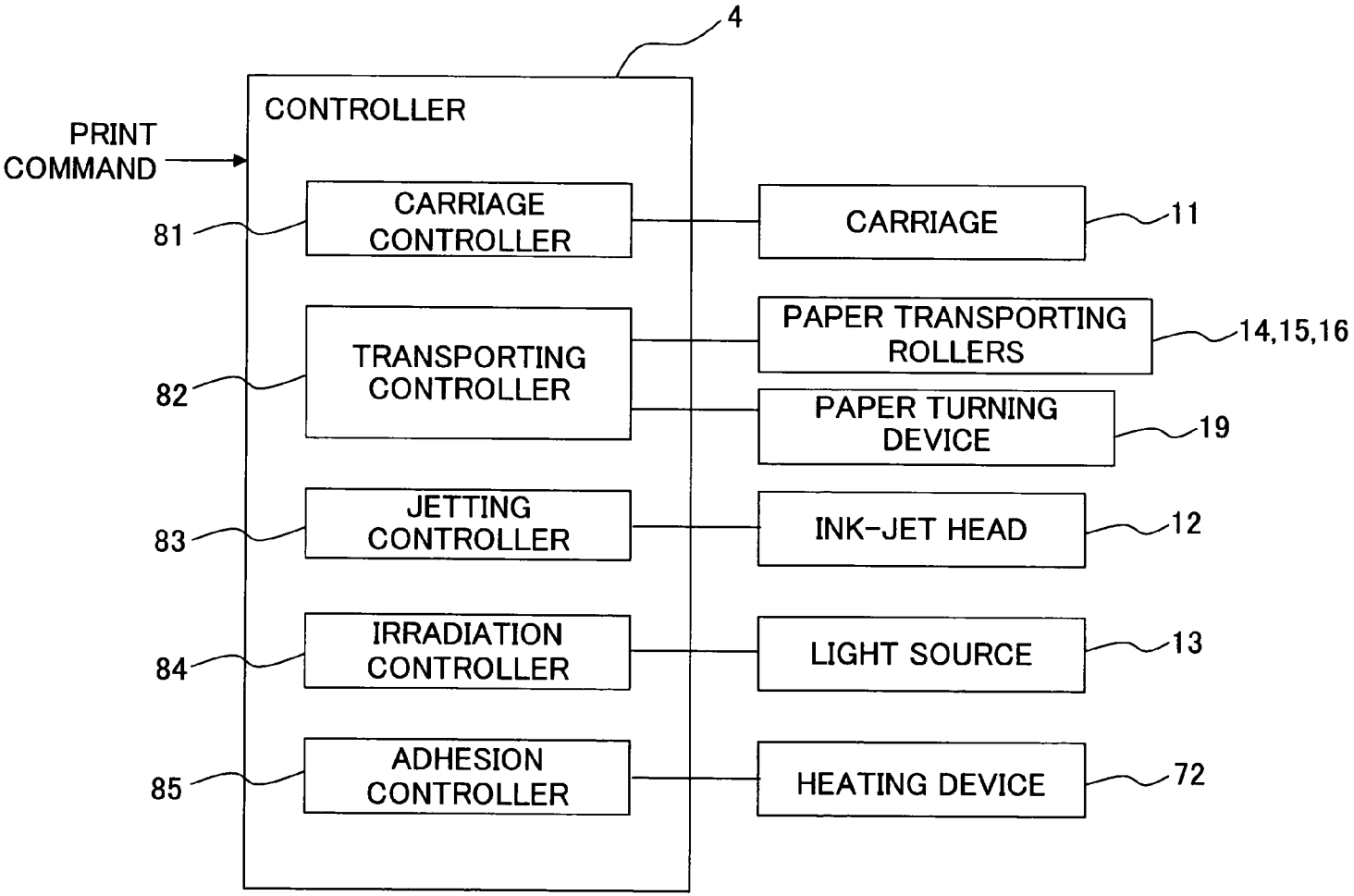
FIG. 9 is a block diagram of a controller.

Next, a controller 4 which controls an operation of the printing apparatus 1 will be described by using FIG. 9. FIG. 9 is a block diagram of the controller 4. When a print command which instructs recording of an image is input from an outside of the printing apparatus 1, the controller 4 controls an operation of each section of the printing apparatus 1 as described below.

The controller 4, as shown in FIG. 9, includes a carriage controller 81, a transporting controller 82, a jetting controller 83, an irradiation controller 84, and an adhesion controller 85. The carriage controller 81 controls reciprocation of the carriage 11 when the inks of four colors and the transparent ink are jetted from the ink-jet head 12, and ultraviolet rays are irradiated by the light sources 13. The transporting controller 82 controls the paper transporting rollers 14 to 16, and the paper turning device 19 at the time of transporting the recording paper P.

The jetting controller 83 controls the ink-jet head 12 such that the inks of four colors and the transparent ink are jetted onto the image formation area P1 at a timing matched with a timing of reciprocating movement of the carriage 11, and a timing when the recording paper P is transported, and the transparent ink is jetted onto the adhesion area P2. Concretely, the jetting controller 83 controls the ink-jet head 12 such that the inks of four colors and the transparent ink are jetted when the nozzles 46 have come to positions facing the image formation area P1, and the transparent ink is jetted when the nozzles 46 have come to positions facing the adhesion area P2. Moreover, the jetting controller 83 controls the ink-jet head 12 such that at the time of recording images on the recording papers P which are to be bound (at the time of recording a plurality of images to be recorded on each recording paper P, having a predetermined order), the recording is performed in an order (starting) from an image to be recorded on the last page (the image recording is performed in an order which is reverse of the predetermined order), and on the recording paper P on which the image is to be recorded last, in other words, onto the adhesion area P2 of the recording paper P which comes first, the transparent ink is not jetted.

The irradiation controller 84 controls the light sources 13 such that the ultraviolet rays are irradiated to the image formation area P1, and not irradiated to the adhesion area P2, at a timing matched with the timing of reciprocating movement of the carriage 11, and the timing when the recording paper P is transported. Concretely, the irradiating controller 84 controls the light sources 13 such that the ultraviolet rays are irradiated when the light sources 13 have come to the positions facing the image formation area P1, and the ultraviolet rays are not irradiated when the light sources 13 have come to the positions facing the adhesion area P2. The adhesion controller 85 controls the heating device 72 such that when all of the recording papers P to be adhered (bound) together are discharged to the paper discharge tray 71, the heating plate 74 which is heated is moved downward along the guide shafts 75, and the recording papers P are heated while being pressed.

Next, in the printing apparatus 1, processes of recording of images on the plurality of recording papers P, and binding the recording papers P by adhering to each other will be described by using FIG. 1A, FIG. 1B, FIG. 10, and FIG. 11. FIG. 10 and FIG. 11 are diagrams showing a first half and a second half respectively of a process of recording an image on one recording paper P.

Figure 10A:
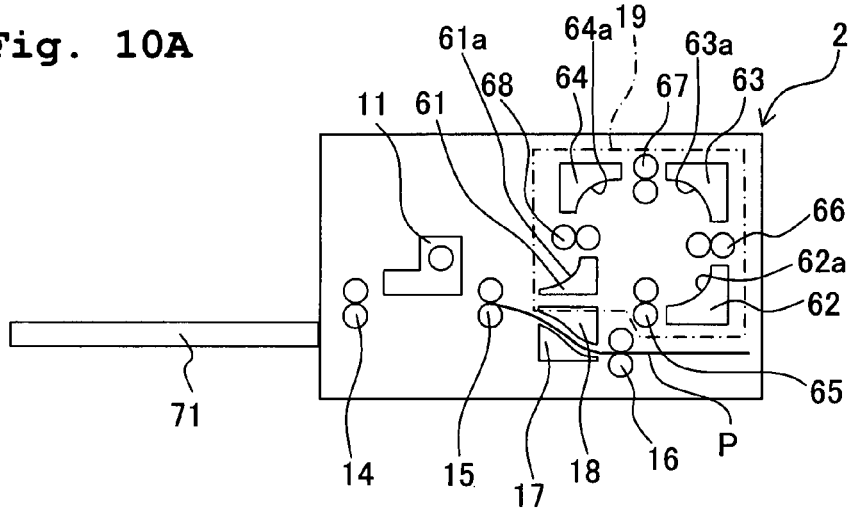
FIG. 10A, FIG. 10B, and FIG. 10C are diagrams showing a first half of a process of recording an image on a recording paper.
Figure 10B:
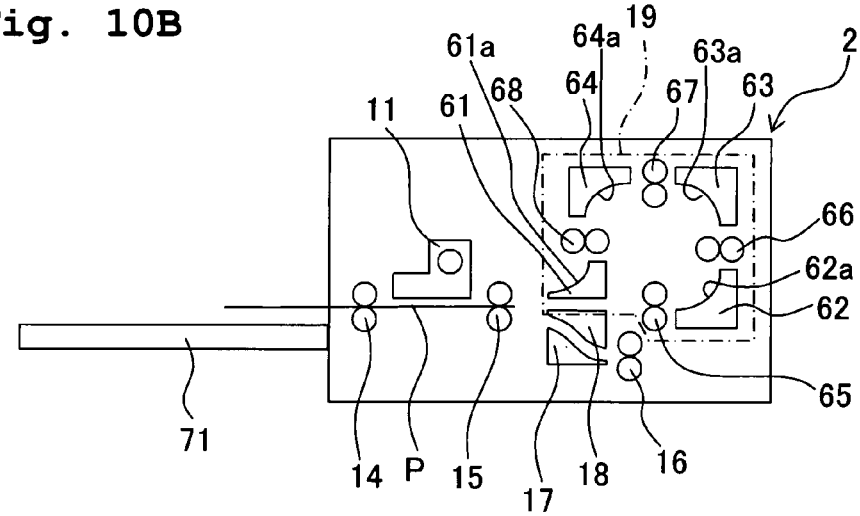

At the time of recording an image, firstly, as shown in FIG. 10A, the recording paper P is transported by the paper transporting rollers 16, and after passing through the gap between the wall 17 and the wall 18, the recording paper Preaches the paper transporting rollers 15. Furthermore, as shown in FIG. 10B, the recording paper P is transported toward a left side by the paper transporting rollers 15, and half way while being transported to the left side, the recording paper P reaches the paper transporting rollers 14, and then is transported in the paper discharge direction by the paper transporting rollers 14 and 15. When the recording paper P is being transported, each portion of the recording paper P faces the ink-jet head 12, and the light source 13 (the recording paper P passes the jetting position and the irradiation position).

When an image is to be recorded on only one surface of the recording paper P, the inks of four colors and the transparent ink are jetted onto the image formation area P1, by the ink-jet head 12, and the transparent ink is jetted to the adhesion area P2. After this, the ultraviolet rays are irradiated to the image formation area P1, from the light sources 13. At this time, the ultraviolet rays are not irradiated to the adhesion area P2. Thereafter, the recording paper P is transported further in the paper discharge direction by the paper transporting rollers 14 and 15, and is discharged to the paper discharge tray 71 as shown in FIG. 1C. Accordingly, the recording paper P is discharged to the paper discharge tray 71 in a state that the inks of four colors and the transparent ink on the image formation area P1 are cured, and the transparent ink on the adhesion area P2 is not cured. Here, the recording paper P is discharged such that a surface including the adhesion area P2 onto which the transparent ink is discharged is facing upward.

On the other hand, when images are to be recorded on both surfaces of the recording paper P, the inks of four colors and the transparent ink are jetted onto the image formation area P1, by the ink-jet head 12, and then, the ultraviolet rays are irradiated to the image formation area P1, by the light sources 13. Accordingly, the inks of four colors and the transparent ink on the image formation area P1 are cured. However, in this case, the transparent ink is not jetted onto the adhesion area P2.

Figure 10C:
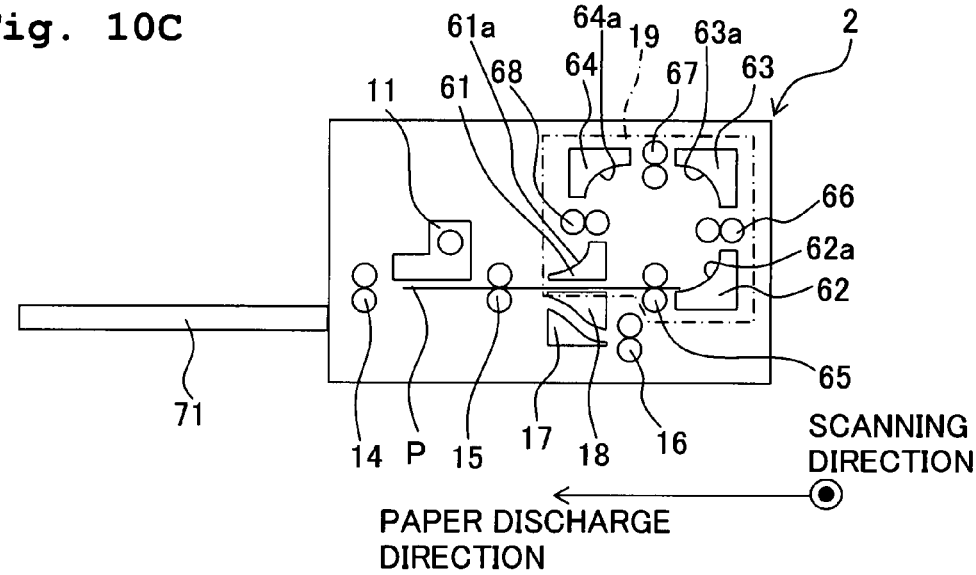

After this, the paper transporting rollers 14 and 15 are rotated in a reverse direction, and the recording paper P is transported in the direction opposite to the paper discharge direction as shown in FIG. 10C, then passes through the gap between the wall 18 and the wall 61, and reaches the paper turning rollers 65.

Figure 11A:
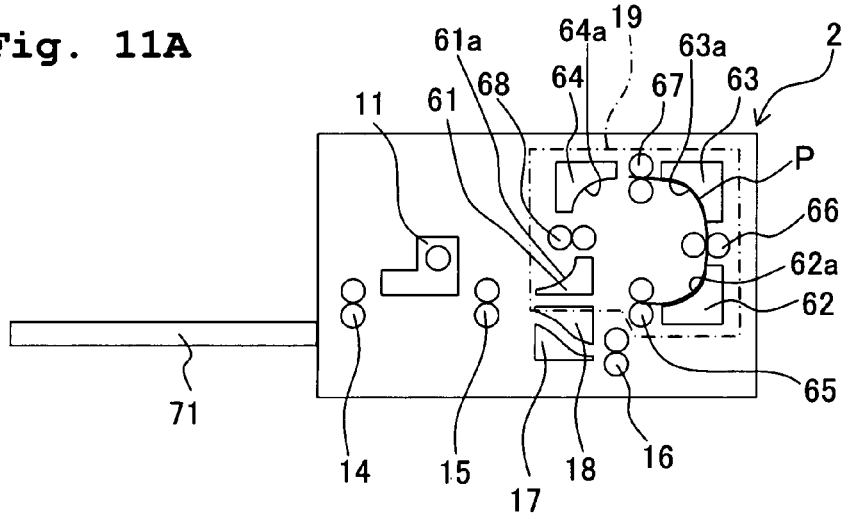
FIG. 11A, FIG. 11B, and FIG. 11C are diagrams showing a second half of the process of recording an image on the recording paper.
Figure 11B:
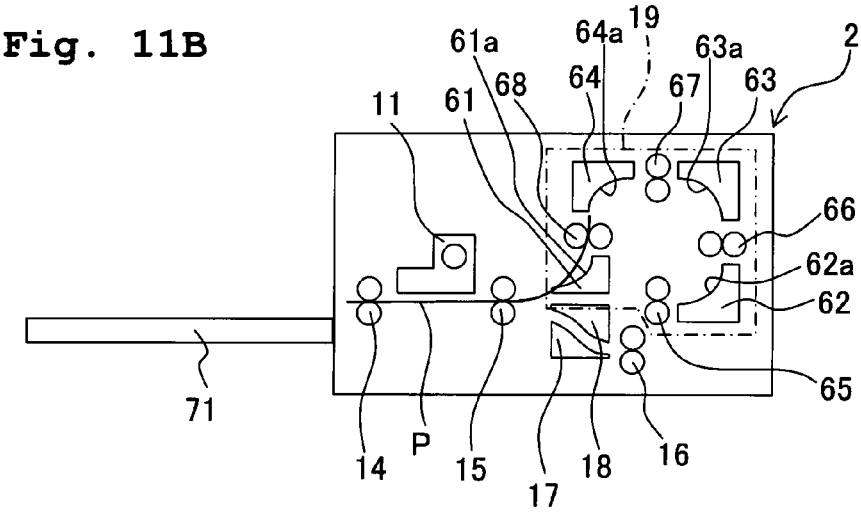

The recording paper P which has reached the paper turning rollers 65, as shown in FIG. 11A, is transported along the upper surface 62*a* of the wall 62, the lower surface 63*a* of the wall 63, and the lower surface 64*a* of the wall 64, by paper turning rollers 65 to 67. Further, as shown in FIG. 11B, the recording paper P is transported along the upper surface 61*a* of the wall 61 by the paper turning rollers 68, and is guided to the paper transportation path L. Accordingly, the paper is guided to an upstream of the paper transportation path L, which is located farther than a portion facing the ink-jet head 12 and the light sources 13, in a state that the paper has been turned over. Moreover, at this time, since the inks of four colors and the transparent ink on the image formation area P1 are cured, and the transparent ink is not jetted onto the adhesion area P2, at the time of turning the recording paper P, the ink may not adhere to the paper turning device 19, or the like, of the printing apparatus 1.

Figure 11C:
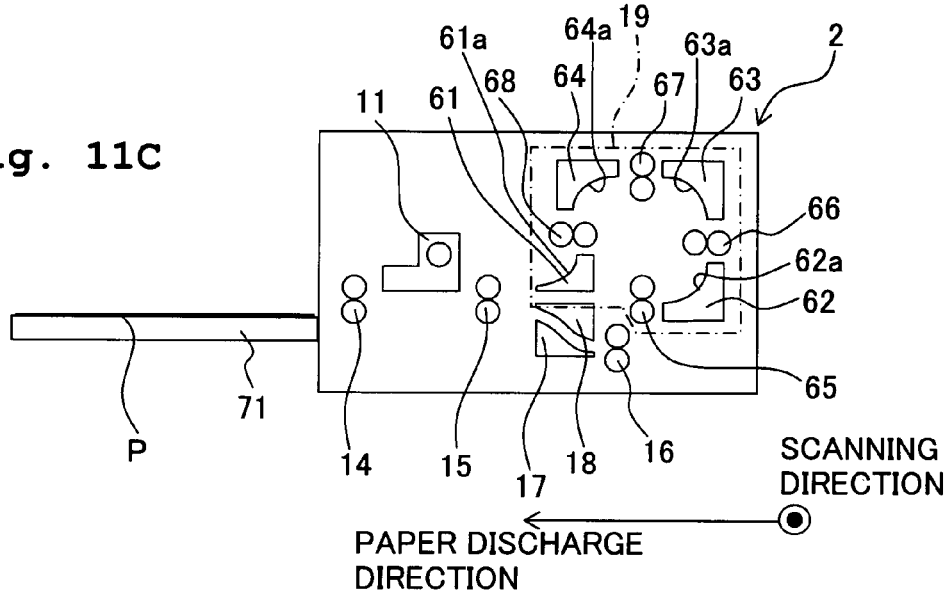

Moreover, as shown in FIG. 11B, the recording paper P is transported in the paper discharge direction once again by the paper transporting rollers 14 and 15, and during the time of transportation, the recording paper P faces the ink-jet head 12 and the light sources 13. At this time, the inks of four colors and the transparent ink are jetted onto the image formation area P1, and the transparent ink is jetted onto the adhesion area P2, by the ink-jet head 12. After the jetting of inks, the ultraviolet rays are irradiated to the image formation area P1 by the light sources 13. At this time, the ultraviolet rays are not irradiated to the adhesion area P2. Thereafter, the recording paper P is transported further in the paper discharge direction by the paper transporting rollers 14 and 15, and is discharged to the paper discharge tray, as shown in FIG. 11(C). Here, the recording paper P is discharged such that a surface including the adhesion area P2 onto which the transparent ink has been jetted is facing upward.

By repeatedly carrying out the operation described above, an image is recorded on the image formation area P1 of each of the plurality of recording papers P, and the transparent ink is jetted onto the adhesion area P2, and these recording papers P are discharged to the paper discharge tray 71 one after the other. However, the transparent ink is not jetted onto the adhesion area P2 of the recording paper P on which the image is recorded last. Here, since the plurality of recording papers P is discharged such that the surface including the adhesion area P2 onto which the transparent ink has been jetted is facing upward, even when, a user takes out by mistake, a recording paper P while performing printing, it is possible to prevent the transparent ink jetted onto the adhesion area P2 of the recording paper P which is subsequently discharged to the paper discharge tray 71, from being adhered to the paper discharge tray 71, or the like.

Moreover, as it has been described above, at the time of recording images on the plurality of recording papers P which are to be bound, the images are recorded in order from an image which is to be recorded on the last page, and the recording paper P is discharged to the paper discharge tray 71 such that the recording paper P is positioned on the recording paper P which is discharged previously. Therefore, by recording the images on the plurality of recording papers P in such order, the recording papers P are arranged in an order of pages (predetermined order) from the top in the paper discharge tray 71.

Furthermore, on the recording paper P which is discharged last (the image is recorded last), any recording paper P is not discharged, and from among the plurality of recording papers p, since the transparent ink is not jetted onto the adhesion area P2 of the recording paper P discharged last to the paper discharge tray 71, an excessive transparent ink is prevented from being jetted onto this recording paper P.

Moreover, at a point of time where all the recording papers P are discharged to the paper discharge tray 71, as it has been mentioned before, due to the downward movement of the heating plate 74 shown in FIG. 1, along the guide shaft 75, the adhesion area P2 of the plurality of recording papers P are heated while being pushed. Accordingly, the transparent ink on the adhesion area P2 is cured, and the plurality of recording papers P is adhered to each other. In this manner, the binding of the recording papers P is carried out. Consequently, the user is not required to carry out a job of applying an adhesive to the plurality of recording papers P on which the images have been recorded, and adhering the plurality of recording papers P to each other upon stacking, and the job of adhering the plurality of recording papers P mutually is simplified. Moreover, as the transparent ink is jetted onto the adhesion area P2, it is possible to carry out binding without applying unnecessary colors to the adhesion area P2.

According to the first embodiment described above, by irradiating light having a light-intensity more than the minimum intensity required for curing the ink only on the image formation area P1 after the inks of four colors and the transparent ink are jetted onto the image formation area P1, and the transparent ink is jetted onto the adhesion area P2, the recording paper P is discharged to the paper discharge tray 71 in a state that the transparent ink on the adhesion area P2 is not cured. Moreover, in this state, for the plurality of recording papers P stacked in the paper discharge tray 71 after being aligned by the wall 73 and the guide shaft 75, the adhesion area P2 is heated while being pressed, by the heating plate 74. Accordingly, the transparent ink on the adhesion area P2 is cured, and it is possible to adhere the plurality of recording papers P to each other. Consequently, the user is not required to carry out the job of applying an adhesive to the plurality of recording papers P on which the images are recorded, and adhering the plurality of recording papers P to each other upon stacking, and the job of adhering the plurality of recording papers P to each other is simplified.

In this case, since the recording paper P is rectangular-shaped, and an area extending along an outer edge of the recording paper of one long-side portion is the adhesion area P2, it is possible to bind the recording papers P by adhering the plurality of recording papers P to each other.

Moreover, since the transparent ink is jetted onto the adhesion area P2, it is possible to adhere the plurality of recording papers P to each other without applying the unnecessary color to the adhesion area P2.

Furthermore, since the plurality of recording papers P is discharged to the paper discharge tray 71 such that the surface including the adhesion area P2 on which the transparent ink is jetted faces upward, even when the user takes out a recording paper P by mistake from the paper discharge tray 71 before all the recording papers to be recorded are discharged, it is possible to prevent the transparent ink jetted onto the adhesion area P2 of the recording paper P which is subsequently discharged, from being adhered to the paper discharge tray 71, or the like.

In the paper discharge tray 71, since the recording paper P is discharged on top of the recording paper P discharged previously (before this recording paper), and at the time of binding the recording papers P, the images are recorded in an order from an image which is to be recorded on the last page, the plurality of recording papers P is arranged in the paper discharge tray 71 in the order of pages (page numbers) from the top. Consequently, it is possible to bind the recording papers P by adhering the plurality of recording papers P in a state that the recording papers have been discharged to the paper discharge tray 71.

Moreover, at the time of recording images on both surfaces of the recording paper P, the transparent ink is not jetted onto the adhesion area P2 when the image is recorded on the image formation area P1 on one surface of the recording paper P, and then, the recording paper P is turned over by the paper turning device 19, and the transparent ink is discharged onto the adhesion area P2 when the image is recorded on the image formation area P1 on the other surface of the recording paper P. Therefore, the recording paper P is turned over by the paper turning device 19 without the transparent ink adhered to the adhesion area P2. Accordingly, it is possible to prevent the transparent ink from being adhered to the paper turning device 19, or the like at the time of turning over the recording paper P.

Furthermore, since the light sources 13 irradiate the ultraviolet rays on the recording paper P while moving in the main scanning direction along with the carriage 11, the purpose is served by a small number of light sources 13.

Next, modified embodiments in which various modifications are made in the first embodiment will be described below.

Not only the transparent ink, but also ink of a single color or inks of plurality of colors, such as inks of four colors may be jetted by patterning appropriately, onto the adhesion area P2. For example, by printing characters 'adhesion area' on the adhesion area P2, it is possible to indicate that this area is the 'adhesion area'. In other words, by jetting an ink other than the transparent ink in the adhesion area P2, information different from information printed on the image formation area P1 may be printed.

Moreover, a structure may be such that the ultraviolet rays having a light-intensity less than the minimum intensity required for curing the ink on the adhesion area P2 are irradiated to the adhesion area P2 by the light sources 13. Even in this case, the recording paper P is discharged to the paper discharge tray 71 with the ink on the adhesion area P2 not cured or half cured. Since the recording papers P discharged to the paper discharge tray 71 are with the ink on the adhesion area P2 in the state of being not cured or half cured, by heating the adhesion area P2 while being pressed by the heating plate 74, the ink on the adhesion area P2 is cured, and the recording papers are adhered mutually. Moreover, when the ink in the adhesion area P2 is in the state of being half cured at the time of recording images on both surfaces of the recording paper P, it is possible to transport the recording paper P without making the ink on the adhesion area P2 adhere to the paper turning device 19 and the paper transporting rollers 14 and 15.

Moreover, the ink jetted onto the adhesion area P2 may be an ink which is cured by a minimum light-intensity which is more than a minimum light-intensity required for curing the inks of four colors jetted onto the image formation area P1, and ultraviolet rays having a light-intensity not lower than the minimum light-intensity required for curing the inks of four colors, and having the intensity lower than the minimum light-intensity required for curing the ink jetted onto the adhesion area P2 may be irradiated to both the image formation area P1 and the adhesion area P2, from the light sources 13.

Even in this case, similarly as in the first embodiment, the recording paper P is discharged to the paper discharge tray 71, with the ink on the image formation area P1 cured, and with the ink on the adhesion area P2 not cured. Moreover, since it is sufficient that the ultraviolet rays of the same intensity are irradiated to the entire recording paper P, it is not necessary to switch the light sources 13 between a state of irradiating the ultraviolet rays and a state of not irradiating the ultraviolet rays, and not to change the intensity of the ultraviolet rays, the control of the light sources 13 becomes easier.

Furthermore, the structure may be such that only the nozzles 46 which jet the inks of four colors are provided to the ink-jet head 12, and the ink of at least one color from among the inks of four colors is jetted onto the adhesion area P2. In other words, at least a part of (some of) the plurality of nozzles 46 (first nozzle group) which jet the ink to the image formation area P1 serve also as the plurality of nozzles 46 (second nozzle group) which jet the ink onto the adhesion area P2. Even in this case, by not irradiating the ultraviolet rays to the adhesion area P2, the recording paper P is discharged to the paper discharge tray 71 with the ink on the adhesion area P2 not cured, and by the adhesion area P2 being heated while being pressed by the heating plate 74, the ink on the adhesion area P2 is cured, and the plurality of recording papers P are adhered to each other. Moreover, in this case, since it is not necessary to provide to the ink-jet head 12, the nozzles 46 jetting the transparent ink in addition to the nozzles 46 which jet the inks of four colors, the structure of the ink-jet head 12 is simplified. Furthermore, information may be added by applying (recording) alphabets and a design by jetting the ink onto the adhesion area P2. By jetting the ink by patterning a logo of a manufacturer of the printing apparatus 1 or a user name of the printing apparatus 1, on the adhesion area P2 for example, it is possible to identify information such as the manufacturer of the printing apparatus 1 and the user of the printing apparatus 1 when the recording papers P adhered mutually at the adhesion area P2 are detached. When it is not necessary to add information to the adhesion area P2, it is preferable to select, for the ink to be jetted onto the adhesion area P2, a color which is least remarkable (noticeable) on the paper, and yellow is the most favorable color out of four colors namely yellow, magenta, cyan, and black.

Moreover, instead of the heating device 72, an arrangement may be such that the ultraviolet rays are irradiated to the adhesion area P2 of the recording paper P which is discharged to the paper discharge tray 71. However, the ultraviolet rays which are irradiated have the intensity not lower than the minimum intensity required for curing the transparent ink. Even in this case, the transparent ink is cured by irradiating the ultraviolet rays to the adhesion area P2 of the plurality of recording papers P discharged to the paper discharge tray 71, and it is possible to adhere the plurality of recording papers P to each other.

A substance to be jetted onto the adhesion area P2 is not restricted to the ink, and may be other liquid which is photo-curable or heat curable (thermosetting). Even in this case, similarly as in the first embodiment, it is possible to adhere the plurality of recording papers P having images recorded thereon to each other, at the adhesion area P2.

In the printing apparatus 1, the plurality of recording papers P was adhered together. However, in the printing apparatus 1, the image may be recorded by jetting the ink onto the image formation area P1 and a liquid for adhering may be jetted to the adhesion area P2. Further, the user may take out the plurality of recording papers P discharged to the paper discharge tray 71, and adhere together the plurality of recording papers P upon curing the transparent ink on the adhesion area P2 at a location other than the printing apparatus 1. Even in this case, since the user is not required to carry out the job of applying an adhesive to the plurality of recording papers P, the job of adhering the plurality of recording papers P together is simplified.

Next, a second embodiment of the present invention will be described below. However, in the second embodiment, points of difference from the first embodiment will be described.

Figure 12:
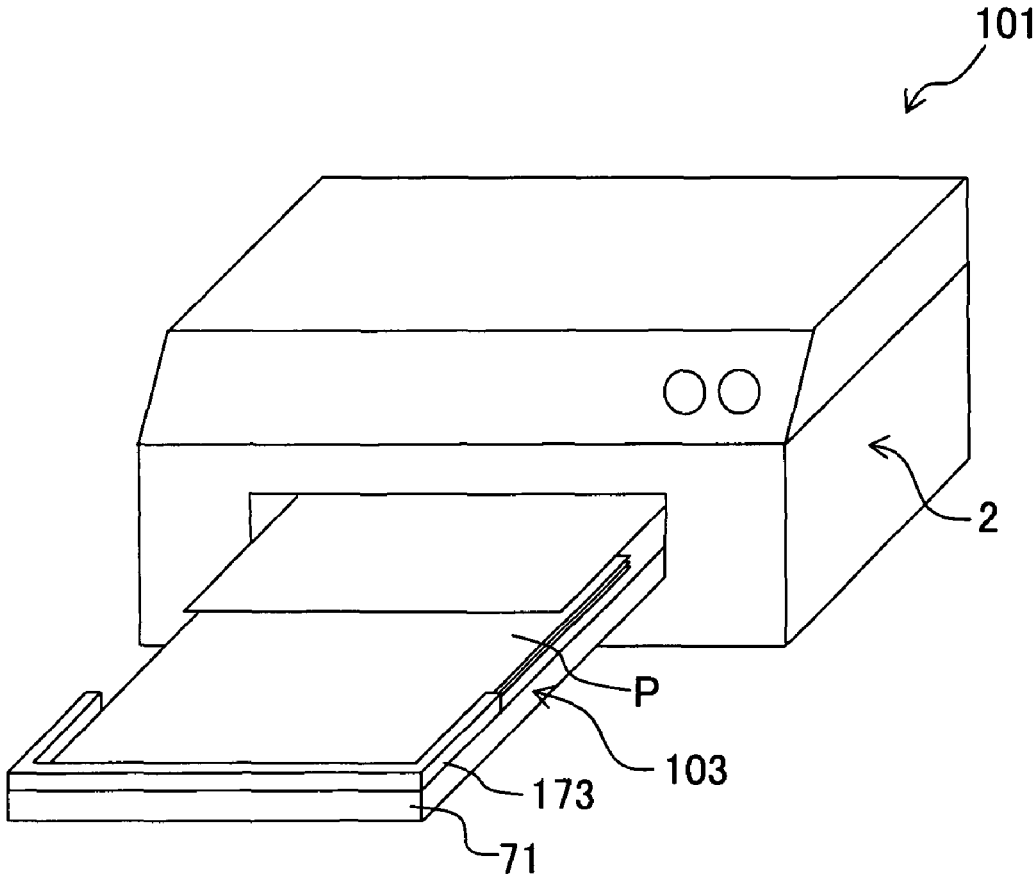
FIG. 12 is a schematic structural view corresponding to FIG. 1, of a printing apparatus according to a second embodiment of the present invention.

FIG. 12 is a schematic structural view corresponding to FIG. 1, of a printing apparatus according to the second embodiment of the present invention. As shown in FIG. 12, a printing apparatus 101 has a structure in which an adhering section 103 is provided instead of the adhering section 3 of the printing apparatus 1 (refer to FIG. 1). The adhering section 103 is not provided with a unit such as the heating device 72 of the first embodiment (refer to FIG. 1) for curing a liquid on the adhesion area P2 of the plurality of recording papers P discharged to the paper discharge tray 71. Moreover, on an upper surface of the paper discharge tray 71, a wall (paper holding mechanism) 173 extending in a vertical direction is provided along an edge thereof, at an end portion of the paper discharge tray 71, on a side opposite to the printing section 2, and at both end portions in a left and right direction of the paper discharge tray 71 in FIG. 12. The recording paper P discharged to the paper discharge tray 71 is aligned by making a contact with a side surface of the wall 173.

Moreover, the printing apparatus 101 includes the printing section 2 having a structure similar to the printing section in the printing apparatus 1 (refer to FIG. 1). However, in the printing apparatus 101, a delayed curing adhesive (liquid) (photo-curable adhesive which takes a longer time to be cured than the ink) is jetted from the plurality of nozzles 46 (second nozzle group) (refer to FIG. 5) which jet the transparent ink in the printing apparatus 1 (refer to FIG. 1). An example of the delayed curing adhesive is a photo-cationic polymerizable resin composition which is made of a cationic polymerizable compound and a cationic polymerizable photoinitiator. Examples of the cationic polymerizable compound are epoxy resins, vinyl prepolymers, and cyclic ethers. On the other hand, examples of the cationic polymerizable photoinitiator which is used in combination with the cationic polymerizable compound are, aromatic diazonium salts, and sulfonium salts.

Figure 13:
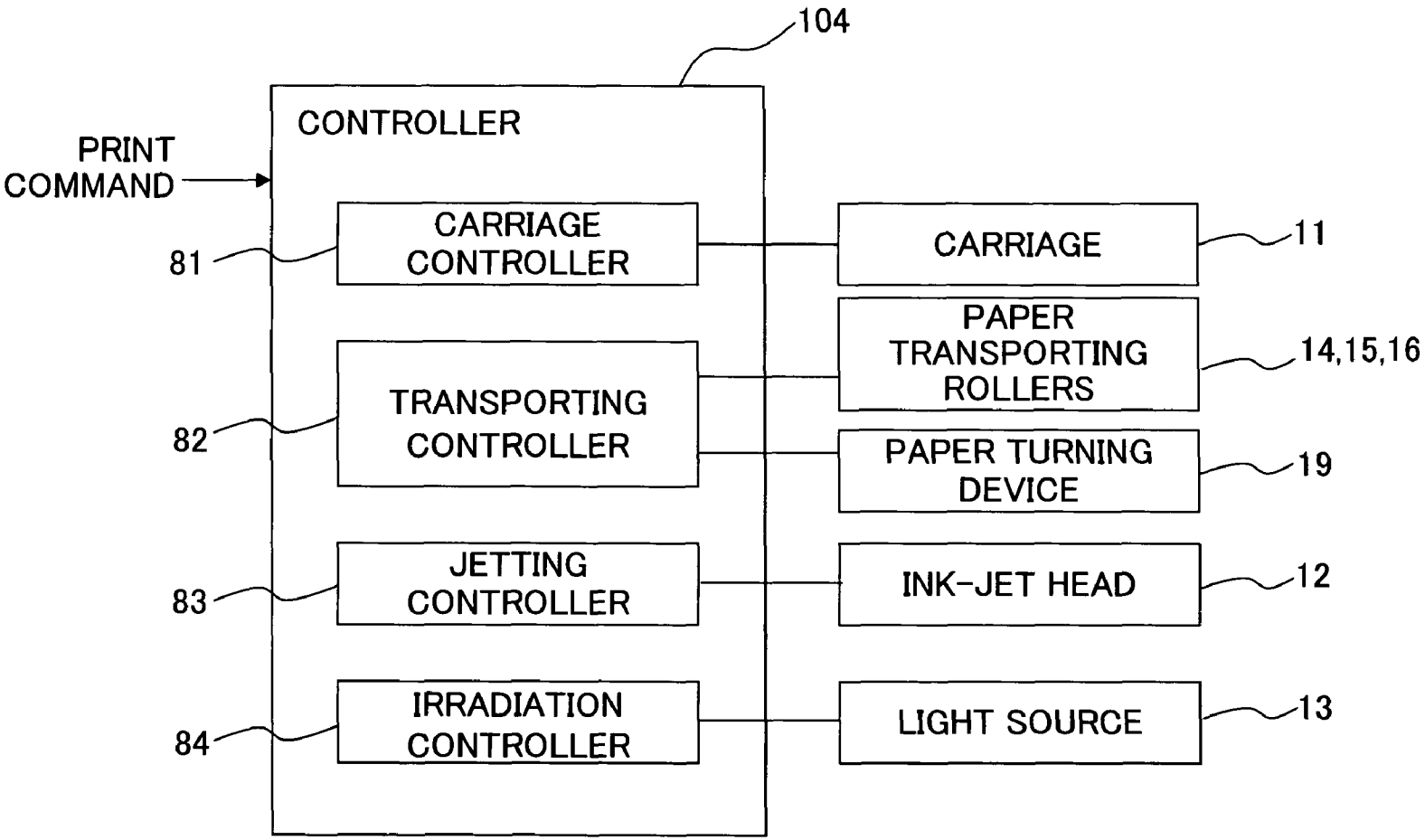
FIG. 13 is a block diagram corresponding to FIG. 9, in the second embodiment.

FIG. 13 is a block diagram corresponding to FIG. 9, of a controller 104. The controller 104 has a structure in which the adhesion controller 85 (refer to FIG. 9) is excluded from the controller 4 (refer to FIG. 9). Moreover, in the controller 104, the jetting controller 83 controls the ink-jet head 12 such that the inks of four colors are jetted onto the image formation area P1, and an adhesive is jetted onto the adhesion area P2. The irradiation controller 84 controls the light sources 13 such that the ultraviolet rays are irradiated to the entire recording paper P including the image formation area P1 and the adhesion area P2.

Next, a process of forming an image on the recording paper P, and binding the plurality of recording papers P by adhering together in the printing apparatus 101, will be described below. In the printing apparatus 101, similarly as in the printing apparatus 1 (refer to FIG. 1), an image is recorded in the printing section 2. However, in the printing apparatus 1, the transparent ink is jetted onto the adhesion area P2, whereas in the printing apparatus 101, the adhesive is jetted onto the adhesion area P2. In the printing apparatus 101, the adhesive is not jetted onto the image formation area P1.

Moreover, in the printing apparatus 1, the ultraviolet rays were irradiated only to the image formation area P1, whereas in the printing apparatus 101, the ultraviolet rays are irradiated to the entire recording paper P including the image formation area P1 and the adhesion area P2. The adhesion area P2 may be formed in the image formation area P1. Regarding the other points, since it is similar to the first embodiment, the description is omitted.

As it has been described above, the recording paper P having the image recorded and the adhesive jetted thereon, is discharged to the paper discharge tray 71 with the inks of four colors cured and the adhesive not cured, and in the paper discharge tray 71, the recording papers P are kept stacked upon being aligned together by making a contact with a side surface of the wall 173. When time is elapsed, with the recording papers P kept in this state, the delayed curing adhesive on the adhesion area P2 is cured, and the plurality of recording papers P is adhered together at the adhesion area P2. Accordingly, the binding of the recording papers P is carried out.

According to the second embodiment described above, the ink jetted onto the image formation area P1 is cured, and later (with a delay), the liquid jetted onto the adhesion area P2 is cured. Further, the plurality of recording papers P with only the ink cured, are arranged in the paper discharge tray 71 piled up upon being aligned by making a contact with the side surface of the wall 173. Therefore, it is possible to carry out binding of the plurality of recording papers P by adhering together at the adhesion area P2.

Next, modified embodiments in which various modifications are made in the first and the second embodiment will be described below. However, same reference numerals are assigned to components having similar structure as in the first embodiment and the second embodiment, and the description to be repeated is omitted.

Figure 14:
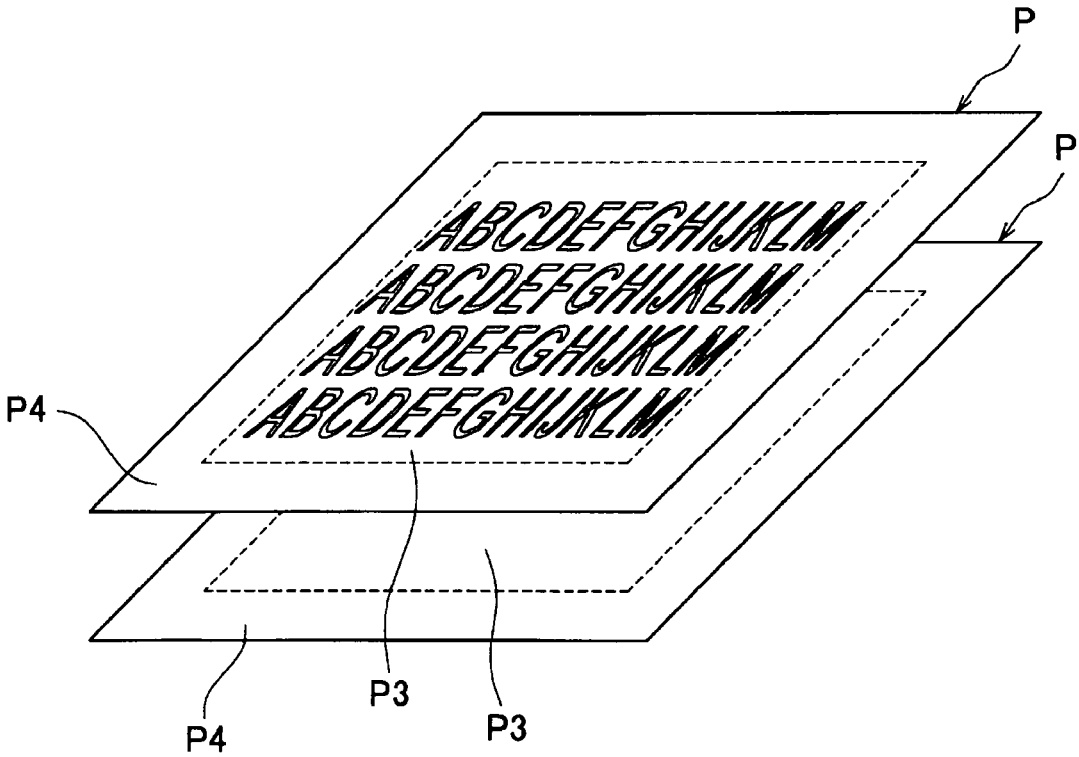
FIG. 14 is a diagram corresponding to FIG. 2, of a first modified embodiment.

In a first modified embodiment, as shown in FIG. 14, an area extending over an entire circumference along an outer edge of the substantially rectangular recording paper P is an adhesion area P4, and an area surrounded by the adhesion area P4 is an image formation area P3. In this case, it is possible to make an envelope by adhering the two recording papers P to each other at the adhesion area P4.

Figure 15:
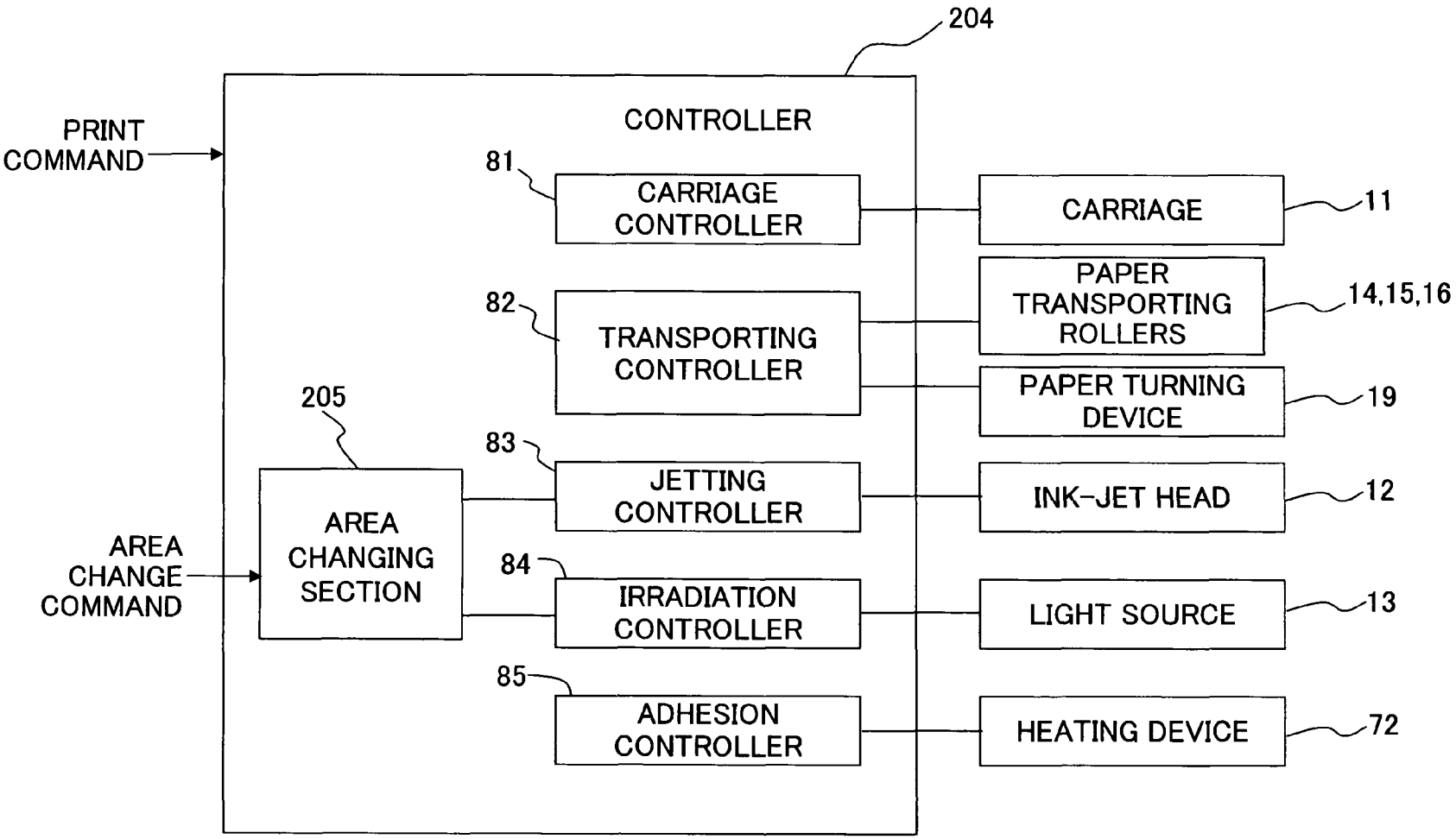
FIG. 15 is a diagram corresponding to FIG. 9, of a second modified embodiment.

In a second modified embodiment, as shown in FIG. 15, a controller 204 further includes an area changing section 205, which changes a position of an image formation area and an adhesion area, when an area changing command which instructs to change the image formation area and the adhesion area is input from an outside. Moreover, the jetting controller 83 controls the ink-jet head 12 such that the inks of four colors and the transparent ink are jetted onto the image formation area which is changed by the area changing section 205, and the transparent ink is jetted onto the adhesion area which is changed by the area changing section 205. The irradiation controller 85 controls the light sources 13 such that the ultraviolet rays are irradiated only to the image formation area which is changed. In this case, since it is possible to set freely the image formation area and the adhesion area, the user is capable of recording an image at a desired position, and to adhere the plurality of recording papers P to each other at a desired position. Here, the second modified embodiment is an outcome of a modification made in the first embodiment, and a similar modification is possible in the second embodiment as well.

Figure 16:
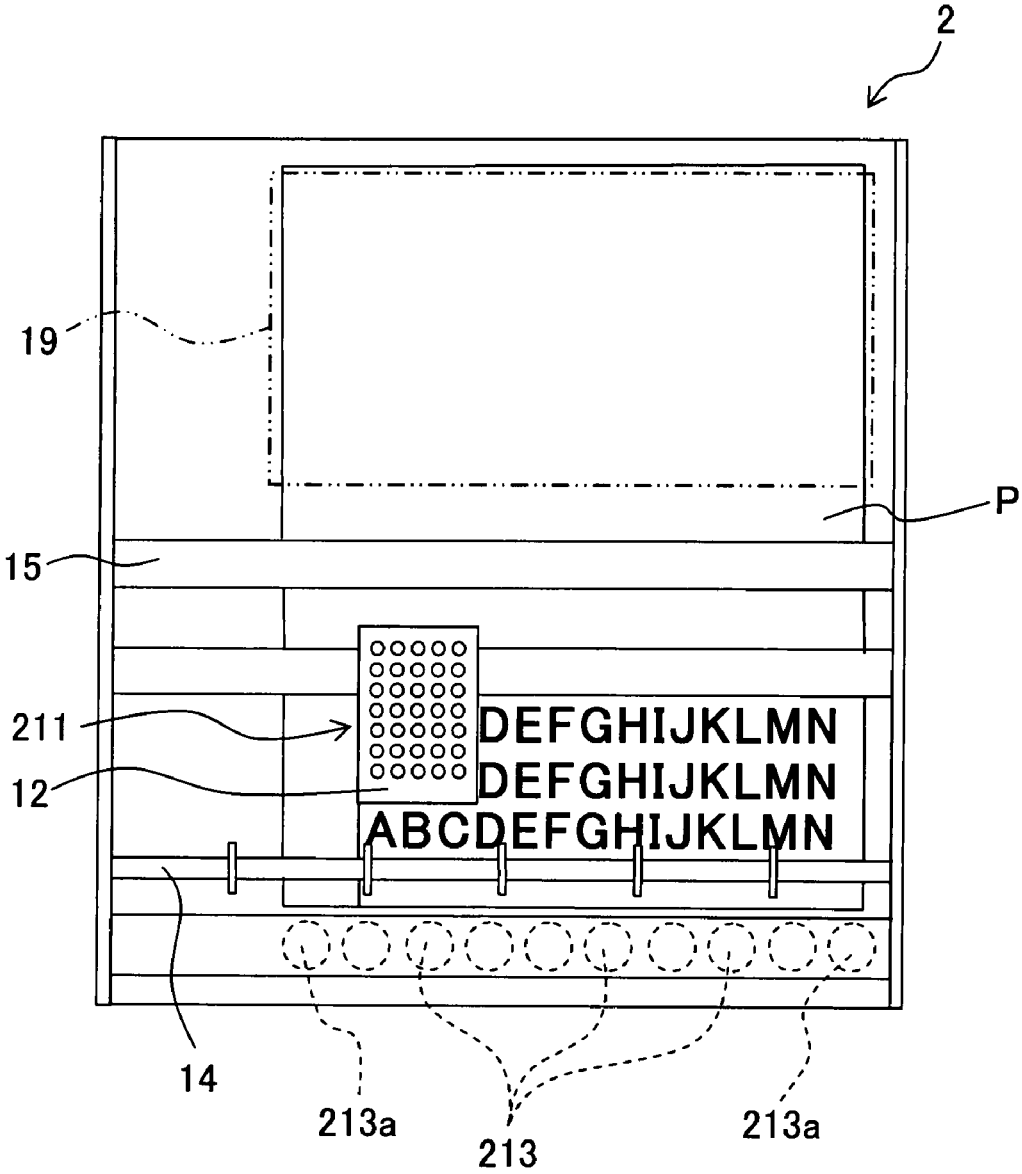
FIG. 16 is a diagram corresponding to FIG. 4 of a third modified embodiment.

In a third modified embodiment, as shown in FIG. 16, only the ink-jet head 12 is installed on a carriage 211, and at a lower side of the ink-jet head 12, in FIG. 16, a plurality of light sources 213 (light irradiating devices) is arranged to be aligned along the entire length of the recording paper P in a left and right direction (direction orthogonal to a transportation path). In this case, a position (irradiation position) of the transportation path L facing the light sources 213 is located farther downstream of a position (jetting position) in the transportation path L facing the ink-jet head 12. In a case of adhering the plurality of recording papers P to each other, the adhesion area is a portion along an outer edge of each of the recording papers P in many cases, as the adhesion area P2 in the first embodiment and the second embodiment, and the adhesion area P4 in the first modified embodiment. In such cases, an arrangement may be made such that among the light sources 213, a light source 213*a* on an outer edge side is not lit. By making such an arrangement, since a frequency of changing the intensity of ultraviolet rays becomes low, it is possible to increase a life of the light sources 213. Furthermore, in this case, a similar effect is achieved by using a line head as an ink-jet head, in which a plurality of nozzles is arranged in series in the scanning direction, and not the ink-jet head 12 which scans along with the carriage 211.

As a fourth modified embodiment, a movable shutter which blocks (cuts off) light irradiated from the light sources 13 may be provided to the light irradiating device in which the carriage 11 and the light sources 13 are combined. For example, a shutter which extends to cover the light sources 13, a housing section which accommodates the shutter, and a motor (or an actuator) which drives the shutter may be provided to the carriage 11. For example, the shutter may be a set of a blocking section, an extendable arm connected to the blocking section, and a plurality of blades which are rotatable. When the light sources 13 come to a position facing the image formation area P1, by the carriage 11, the shutter is accommodated in the housing section by controlling the motor. When the light sources 13 come to a position facing the adhesion area P2, the motor is controlled such that the shutter comes out of the housing section and to block (cut off) the light from the light sources 13. By doing this, it is possible to make an arrangement such that the light from the light sources 13 is irradiated to the image formation area P1, and not irradiated to the adhesion area P2. In other words, it is not necessary to control the light sources 13 for switching the intensity of light, according to the image formation area P1 and the adhesion area P2. Moreover, it is not necessary to use properly (separately) inks which are cured by different light intensity, according to the image formation area P1 and the adhesion area P2.

In the abovementioned description, examples in which the present invention is applicable to a printing apparatus which performs recording have been described. However, embodiments to which the present invention is applicable are not restricted to the embodiments described above. The present invention is not restricted to the printing apparatus which records an image, and is applicable to apparatuses used in various fields such as medical treatment and analysis, provided that it is an apparatus which changes properties and state of liquid droplets jetted, by changing the intensity of light which is irradiated.

What is claimed is:

1. A printing apparatus which performs recording on a recording paper, comprising:

a liquid jetting device which includes a first nozzle group which jets a photo-curable ink onto the recording paper, and a second nozzle group which jets a photo-curable liquid onto the recording paper;

a light irradiating device which irradiates light to the recording paper;

a transporting mechanism which transports the recording paper along a transportation path including a jetting position at which the ink and the liquid are jetted by the liquid jetting device, an irradiation position at which the light is irradiated by the light irradiating device, and a discharge position at which the recording paper is discharged; and a controller which controls an operation of the liquid jetting device, an operation he light irradiating device, and an operation of the transporting mechanism;

wherein in the transportation path, the discharge position is located downstream of the jetting position and the irradiation position;

wherein the controller controls the liquid jetting device, the light irradiating device, and the transporting mechanism such that the ink is jetted onto an image formation area of the recording paper, on which the image is to be recorded and the liquid is jetted onto an adhesion area of the recording paper at which the recording paper is adhered to another recording paper, and that a light having a light-intensity not less than a minimum light-intensity required for curing the ink is irradiated to the image formation area onto which the ink has been jetted, and a light having a light-intensity less than a minimum light-intensity required for curing the liquid is irradiated to the adhesion area onto which the liquid has been jetted or that a light is not irradiated onto the adhesion area; and wherein the printing apparatus further comprises:

a paper holding mechanism which holds a plurality of recording papers transported by the transporting mechanism to the discharge position in a state that the recording papers are stacked and aligned mutually; and a liquid curing device which cures the liquid discharged onto the adhesion area of the recording papers which are held by the paper holding mechanism.

2. The printing apparatus according to claim 1;

wherein the adhesion area differs from the image formation area.

3. The printing apparatus according to claim 1;

wherein the liquid curing device irradiates a light having a light-intensity not less than the minimum light-intensity required for curing the liquid to the adhesion area.

4. The printing apparatus according to claim 1;

wherein the liquid has a thermosetting property; and the liquid curing device heats the adhesion area at a temperature not less than a minimum temperature required for curing the liquid.

5. The printing apparatus according to claim 1;

wherein the minimum light-intensity of light required for curing the liquid is more than the minimum light-intensity required for curing the ink; and wherein the controller controls the light irradiating device such that a light having the light-intensity not less than the minimum light-intensity required for curing the ink and having the light-intensity less than the minimum light-intensity required for curing the liquid is irradiated to the image formation area and the adhesion area.

6. A printing apparatus which performs recording on a recording paper, comprising:

a liquid jetting device which includes a nozzle group which jets a photo-curable ink onto the recording paper;

a light irradiating device which irradiates light to the recording paper;

a transporting mechanism which transports the recording paper along a transportation path including a jetting position at which the ink is jetted by the liquid jetting device, an irradiation position at which the light is irradiated by the light irradiating device, and a discharge position at which the recording paper is discharged;

a controller which controls an operation of the liquid jetting device, an operation of the light irradiating device, and an operation of the transporting mechanism; and a paper holding mechanism which holds a plurality of recording papers transported by the transporting mechanism to the discharge position in a state that the recording papers are stacked and aligned mutually;

wherein, in the transportation path, the discharge position is located downstream of the jetting position and the irradiation position;

wherein the controller controls the liquid jetting device, the light irradiating device, and the transporting mechanism such that the ink is jetted onto an image formation area of the recording paper, on which the image is to be recorded and the ink is jetted onto an adhesion area of the recording paper at which the recording paper is adhered to another recording paper, and that a light having a light-intensity not less than a minimum light-intensity required for curing the ink is irradiated to the image formation area onto which the ink has been jetted, and a light having a light-intensity less than the minimum light-intensity is irradiated to the adhesion area onto which the liquid has been jetted or that a light is not irradiated onto the adhesion area.

7. A printing apparatus which performs recording on a recording paper, comprising:

a liquid jetting device which includes a first nozzle group which jets a photo-curable ink onto a recording paper, and a second nozzle group which jets, onto the recording paper, a photo-curable liquid requiring a curing time longer than a curing time for the ink;

a light irradiating device which irradiates light to the recording paper;

a transporting mechanism which transports the recording paper along a transportation path including a jetting position at which the ink and the liquid are jetted by the liquid jetting device, an irradiation position at which the light is irradiated by the light irradiating device, and a discharge position at which the recording paper is discharged;

a paper holding mechanism which holds a plurality of recording papers transported by the transporting mechanism to the discharge position in a state that the recording papers are stacked and aligned mutually; and a controller which controls an operation of the liquid jetting device, an operation of the light irradiating device, and an operation of the transporting mechanism;

wherein in the transportation path, the discharge position is located downstream of the jetting position and the irradiation position; and wherein the controller controls the liquid jetting device, the light irradiating device, and the transporting mechanism such that the ink is jetted onto an image formation area of each of the recording papers, on which the image is to be recorded and the liquid is jetted onto an adhesion area of each of the recording papers to adhere the recording papers to each other, and that a light having a light-intensity not less than a minimum light-intensity required for curing both the ink and the liquid is irradiated to the image formation area onto which the ink has been jetted, and the adhesion area onto which the liquid has been jetted.

8. The printing apparatus according to claim 7;

wherein the adhesion area differs from the image formation area, and the liquid is transparent.

9. The printing apparatus according to claim 7;

wherein each of the recording papers is rectangular-shaped, and the adhesion area is an area extending at one side portion of each of the recording papers along an outer edge of each of the recording papers.

10. The printing apparatus according to claim 7;

wherein each of the recording papers is rectangular-shaped, and the adhesion area is an area extending over an entire periphery along an outer edge of each of the recording papers.

11. The printing apparatus according to claim 7, further comprising:

an area changing section which changes a position of the image formation area and a position of the adhesion area according to an instruction from an outside of the printing apparatus.

12. The printing apparatus according to claim 7;

wherein the transporting mechanism is constructed such that each of the recording papers is transported with a surface, onto which the liquid has been jetted, facing upward;

wherein the paper holding mechanism is constructed such that the recording papers are held in a stacked state in which a recording paper, which is transported later among the printing papers is on a top of the stack; and wherein the controller controls the liquid jetting device such that the liquid is not jetted onto the adhesion area of a recording paper which is transported last to the discharge position among the recording papers to be adhered mutually.

13. The printing apparatus according to claim 12;

wherein the controller controls the liquid jetting device such that, upon recording a plurality of images on the recording papers respectively in a predetermined order, the images are recorded on the recording papers respectively in an order which is reverse to the predetermined order.

14. The printing apparatus according to claim 7, further comprising;

a paper turning device which turns over the recording papers which have passed the discharge position and the irradiation position, and guides the recording papers to an upstream of the transportation path to be located farther than the discharge position and the irradiation position;

wherein the controller controls operations of the liquid jetting device, the light irradiating device, the transporting mechanism, and the paper turning device such that before the recording papers are turned over, the liquid is not jetted onto the adhesion area on one surface of each of the recording papers and the ink is jetted onto the image formation area on the one surface of each of the recording papers, and the light is irradiated to the one surface onto which the ink is jetted, and that after the recording paper s turned over, the ink is jetted onto the image formation area on the other surface, of each of the recording papers, on a side opposite to the one surface onto which the ink has been jetted, and the liquid is jetted onto the adhesion area on the other surface, and light is irradiated to the other surface onto which the ink and the liquid have been jetted.

15. The printing apparatus according to claim 7;

wherein in the transportation path, the irradiation position is located downstream of the jetting position; and wherein the light irradiating device includes a plurality of light sources which are provided facing the irradiation position, and arranged to be aligned along an entire length of each of the recording papers, in a direction orthogonal to a direction in which each of the recording papers is transported at the irradiation position.

16. The printing apparatus according to claim 7;

wherein the light irradiating device includes a light source which irradiates the light to the recording paper; and a reciprocating mechanism which reciprocates the light source at a position facing the irradiation position, over an entire length of each of the recording papers, in a direction orthogonal to a direction in which the recording paper is transported at the irradiation position.

* * * * *